United States Patent [19]

Takano

[11] Patent Number: 5,044,967

[45] Date of Patent: Sep. 3, 1991

[54] ELECTRICAL CONNECTORS

[75] Inventor: Tsunesuke Takano, Tokyo, Japan

[73] Assignee: Kabushiki Kaisha T AN T, Tokyo, Japan

[21] Appl. No.: 534,640

[22] Filed: Jun. 7, 1990

[30] Foreign Application Priority Data

| | | | |
|---|---|---|---|
| Jun. 7, 1989 | [JP] | Japan | 1-66391[U] |
| Jun. 7, 1989 | [JP] | Japan | 1-66393[U] |
| Jul. 12, 1989 | [JP] | Japan | 1-82055[U] |
| Jul. 26, 1989 | [JP] | Japan | 1-87885[U] |
| Jul. 26, 1989 | [JP] | Japan | 1-87886[U] |
| Jul. 26, 1989 | [JP] | Japan | 1-87887[U] |

[51] Int. Cl.[5] ..... H01R 9/09

[52] U.S. Cl. ..... 439/79; 361/407

[58] Field of Search ..... 439/55, 78, 79, 80, 439/76, 92, 101, 108; 361/404, 406, 407

[56] References Cited

U.S. PATENT DOCUMENTS

| | | | |
|---|---|---|---|
| 4,355,853 | 10/1982 | Kovrimsky | 439/76 |
| 4,585,285 | 4/1986 | Martens | 439/62 |
| 4,752,254 | 6/1988 | Inoue et al. | 361/407 |
| 4,867,696 | 4/1989 | Demler, Jr. | 439/212 |
| 4,874,319 | 10/1989 | Hasircoglu | 439/108 |
| 4,881,905 | 11/1989 | Demler | 439/79 |
| 4,909,745 | 3/1990 | Hayash | 439/76 |
| 4,959,019 | 9/1990 | Shimochi | 439/76 |

FOREIGN PATENT DOCUMENTS 58-10306 2/1983 Japan .

*Primary Examiner*—Neil Abrams

*Attorney, Agent, or Firm*—Nixon & Vanderhye

[57] ABSTRACT

Electrical connectors include a base (preferably formed of a plastics material) having an upright retaining wall. An electrically conductive bus plate has a base portion disposed adjacent a forward surface of the retaining wall so that a male terminal projects forwardly therefrom. A tubular housing is coupled to the base forwardly of the retaining wall via resilient tongue structures, and includes an opening through which the male terminal extends. When mounted to the base, a rear wall of the tubular housing will forcibly press the base portion of the male terminal against the retaining wall so as to rigidly hold the male terminal positionally within the tubular housing. In such a manner, the electrical connectors of the present invention minimize (if not eliminate entirely) distortion and/or positional skewing of the male terminal. A female plug body having female terminals may thus be inserted within the tubular housing so that the male terminal and female terminal are mated thereby establishing electrical communication with an external circuit, for example.

26 Claims, 26 Drawing Sheets

ELECTRICAL CONNECTORS

CROSS-REFERENCE TO PRIORITY APPLICATIONS

This application is based upon the following Japanese Utility Model Application Nos. for purposes of priority under 35 USC §119: 1-66391 filed on June 7, 1989; 1-66393 filed on June 7, 1989; 1-82055 filed on July 12, 1989; 1-87885 filed on July 26, 1989; 1-87886 filed on July 26, 1989; and 1-87887 filed on July 26, 1989. The entire content of each of the above-referenced Japanese Utility Model Applications upon which priority is claimed is hereby expressly incorporated hereinto by reference thereto.

FIELD OF INVENTION

The present invention generally relates to the field of electrical connectors. More particularly, the present invention relates to electrical connectors whereby the base section of male terminals associated with conductive plates (usually called "bus bars") may be positionally captured, and hence securely retained, by a tubular housing member for the male terminals and the means that couple the same to the base. In such a manner, deformation and/or positional skewing of the male terminals can be minimized (if not eliminated entirely).

BACKGROUND AND SUMMARY OF THE PRESENT INVENTION

1. Description of the Prior Art

Electrical connectors having a connector housing and capable of establishing electrical connection with external circuits are known. In this regard, please see Japanese Utility Model Publication No. 58-10306. The conventional connector structure described in Japanese Utility Model publication No. 58-10306 comprises a connector housing capable of accommodating a plurality of female terminals which may respectively be coupled to a plurality of parallel male terminals. The connector housing of the type described in Japanese Utility Model publication 58-10306 includes an insulating wall disposed perpendicular with respect to the housing's side walls that are formed in the longitudinal direction of a frame. The resulting terminal accommodating chambers that are formed thereby are open-ended.

Furthermore, slanted guide surfaces are formed at a lower end portion of the insulating wall at positions on the inside and outside thereof which do not coincide with the lower open end of the frame. The above-described conventional structure may be fastened to the circuit board using a separate cover plate by means of screws that extend through holes formed in flanges associated with the lower portion of the housing.

The cover plate must be prepared and mounted separately of the electrical connector. Thus, increased complexity of the work needed for fabricating the connector ensues. Therefore, one problem that arises with the prior art electrical connector described above is that the overall cost of the connector increases. In addition, since the housing is fixed to the circuit board separately via screws, tools (e.g., screwdrivers) are needed which may not always be accommodated easily (if at all) in the close confines of a particular circuit board layout. As a result, fabrication efficiencies and/or productivities decrease.

A further problem with the above-described conventional electrical connector is that the base section of the male terminals cannot be retained by the lower surface of the housing. Therefore, the upper surface of the circuit board positioned away from the base is pressed towards the circuit board by the lower portion of the inside surface of the housing flange. As a result, the base portions of the male terminals and/or the male terminals themselves can be easily deformed and/or positionally skewed.

2. Summary of the Invention

The present invention is directed towards solutions to the problems associated with the above-described electrical connector of the prior art. Broadly, the present invention provides an electrical connector which is comprised of a base which includes at least one male terminal, and a tubular housing for the male terminal which is adapted to receiving a female plug body. More specifically, the tubular housing is coupled to the base such that the electrically conductive base section of the male terminal (i.e., that section of the male terminal that joins the same to the conductive bus bar) is forcibly captured, and hence positionally restrained, between a rear wall of the housing, and an integral retaining wall extending upwardly from the base. The forwardly extending male terminal is therefore protectively housed within the interior of the tubular housing structure.

The tubular housing is maintained in its coupled position with respect to the base by means of resilient coupling structures. Thus, the tubular housing is prevented from being uncoupled from the base and, as a result, maintains its positional restraint upon the base section of the male terminals.

In this regard, several embodiments of the resilient coupling structures will be discussed in greater detail below. In general, however, each will be in the form of a resilient tongue element formed integrally with either the tubular housing or the base, with an engagement surface being provided on the other of the tubular housing or base. When in its "seated" position—i.e., when the tubular housing is coupled to the base—the resilient tongue will engage the engagement surface and hence prevent uncoupling thereof. Moreover, when the housing is coupled to the base, the capturing force exerted by the housing's rear wall against the base section of the male terminals will be maintained thereby providing rigidifying mechanical support for the male terminals. As a result, deformation and/or positional skewing of the male terminals is minimized (if not eliminated).

The coupling means of the present invention is also provided with guide and mounting structures that allow the housing member to be slidably moved onto the base during assembly thereof. Thus, the structures that allow sliding of the tubular housing onto the base, together with the resilient tongue element and its associated engagement surface, permit the electrical connectors to be fabricated without the use of tools. Moreover, the electrical connectors of this invention can be assembled in a so-called "one touch" manner. That is, by simply sliding the tubular housing into engagement with the base until its final, coupled position is achieved, the tubular housing will be securely mounted to the base so that it cannot readily be uncoupled. At the same time, the male terminals are protected due to the surrounding presence of the housing, and the increased mechanical support that the housing provides thereto.

These aspects and advantages of the present invention, as well as others, will become more clear after careful consideration is given to the detailed description of the preferred exemplary embodiments thereof which follow.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1A:
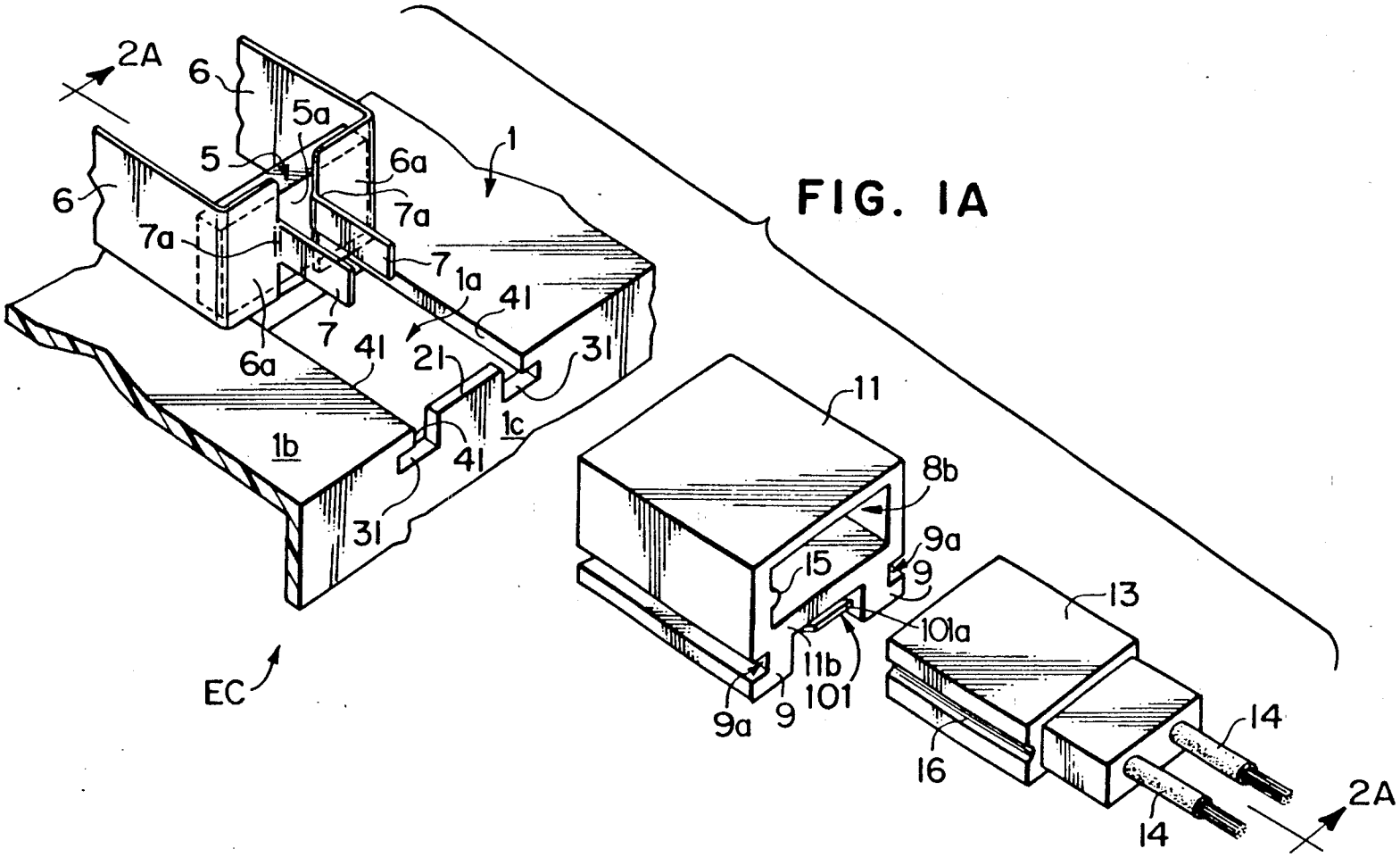
FIGS. 1A–1F are each perspective views of respective electrical connector embodiments according to the present invention, the electrical connectors being shown in a disassembled state thereof whereby the base, tubular housing, and female plug body are separated one from the other.

The basic structures according to a particularly preferred embodiment of an electrical connector EC according to the present invention is shown in accompanying FIGS. 1A–8A. As is shown especially in FIGS. 1A and 2A, the electrical connector EC generally includes an electrically insulating base member 1 to which a tubular housing 11 may be coupled (as will be described in greater detail below). A female plug member 13 may then be inserted into the tubular housing 11 so as to establish electrical communication with an external circuit, for example.

The base 1 itself defines an opening **1*a* in its upper surface 1*b* that, in turn, establishes an opposing, separated pair of longitudinally extending rail edges 41. These rail edges 41, moreover, form an upper integral portion of a pair of opposing, but mirror-imaged, L-shaped slots 31 that are defined in a forward wall 1*c* of the base member 1. The pair of slots 31 thus establish therebetween a vertically extending stop plate 21 which is an integral part of the front wall 1*c* of base member 1**.

The base member 1 may be fabricated from virtually any electrically insulating material. However, it is presently preferred to fabricate the same from a plastics material which is electrically insulating and which provides the necessary mechanical strength properties required of electrical connectors generally. One particularly preferred material is nylon 6,6.

An upright (substantially vertical) retaining wall 5 is integrally provided on the upper surface **1*b* of the base member 1 at the rearward extent of opening 1*a* formed in the base member 1. The retaining wall 5 is, like base member 1, also formed of an electrically insulating material, preferably the same material forming the base member 1. Elongated metal conductive plates 6 are supported on the base 1 and include forward bent portions 6*a* which lap over the forwardmost surface 5*a* of the retaining wall 5. Each of the elongated conductive plates 6 include relatively narrower male terminals 7 that project forwardly parallel relative to one another (and relative to the parallel rail edges 41). Moreover, these male terminals 7 are separated from one another by a dimension which is less than the lateral separation dimension between the opposing rail edges 41**.

Figure 2A:
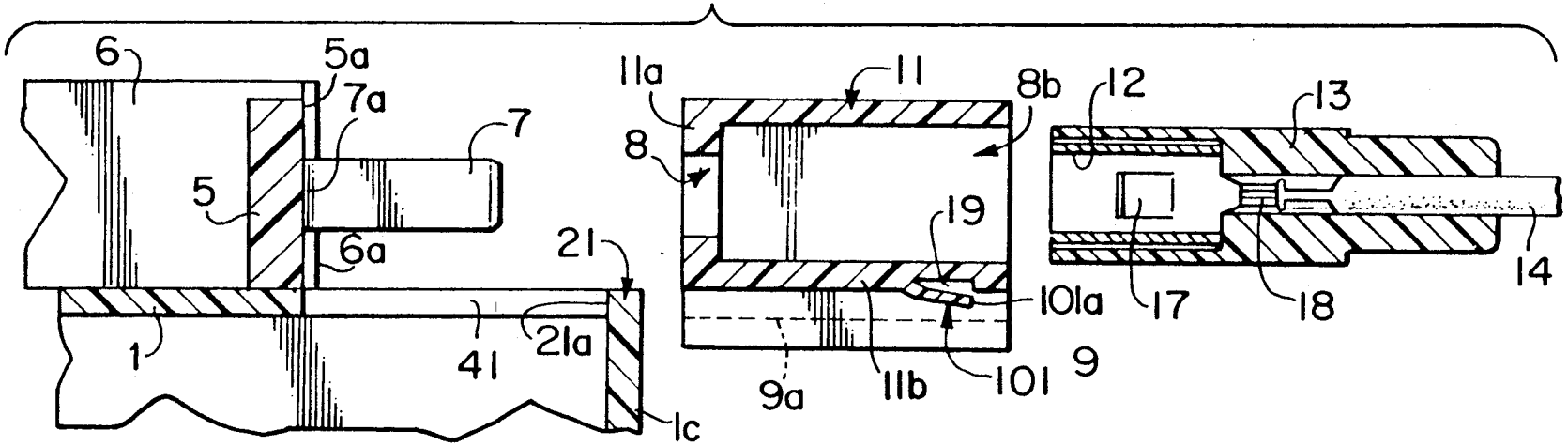
FIGS. 2A–2F are each vertical cross-sectional views of the respective electrical connector embodiments shown in FIGS. 1A–1F as taken along respective section lines therein, and thus are likewise shown in a disassembled state thereof.
Figure 2B:
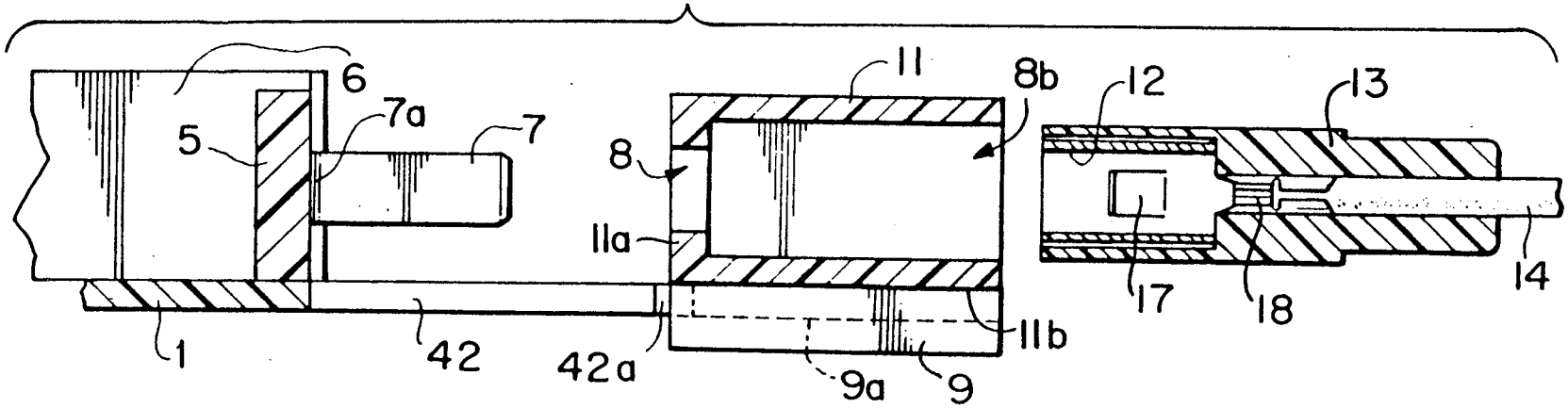
Figure 2C:
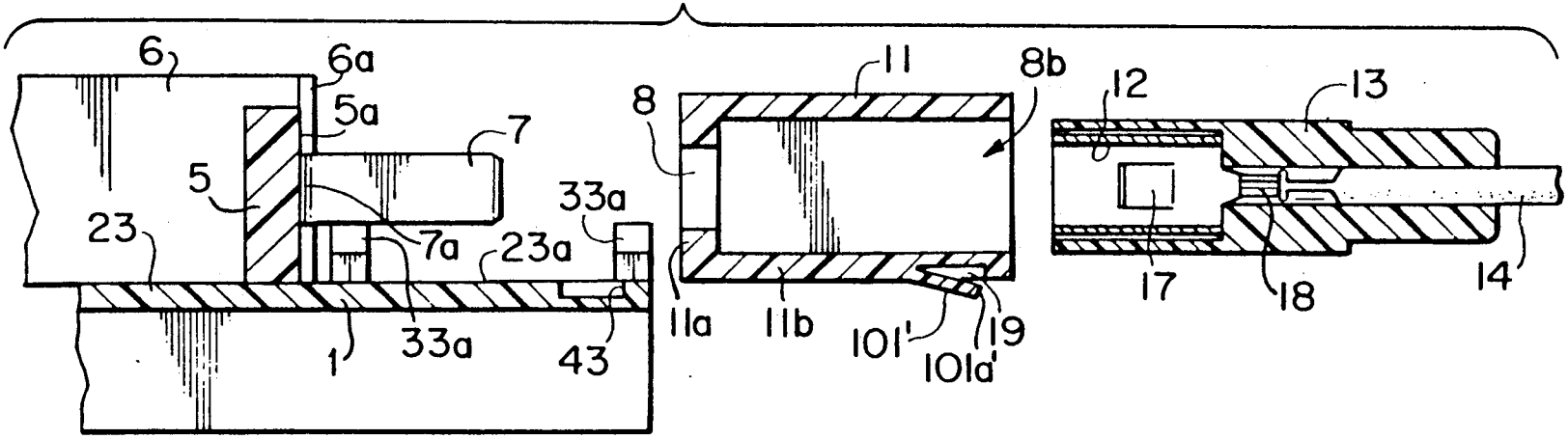
Figure 2D:
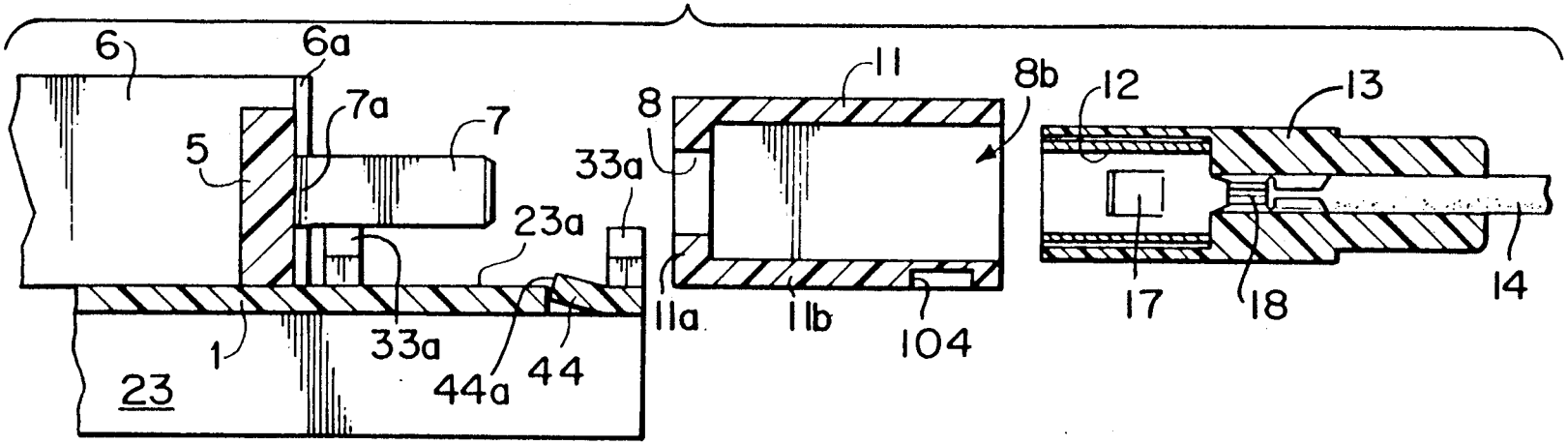
Figure 2E:
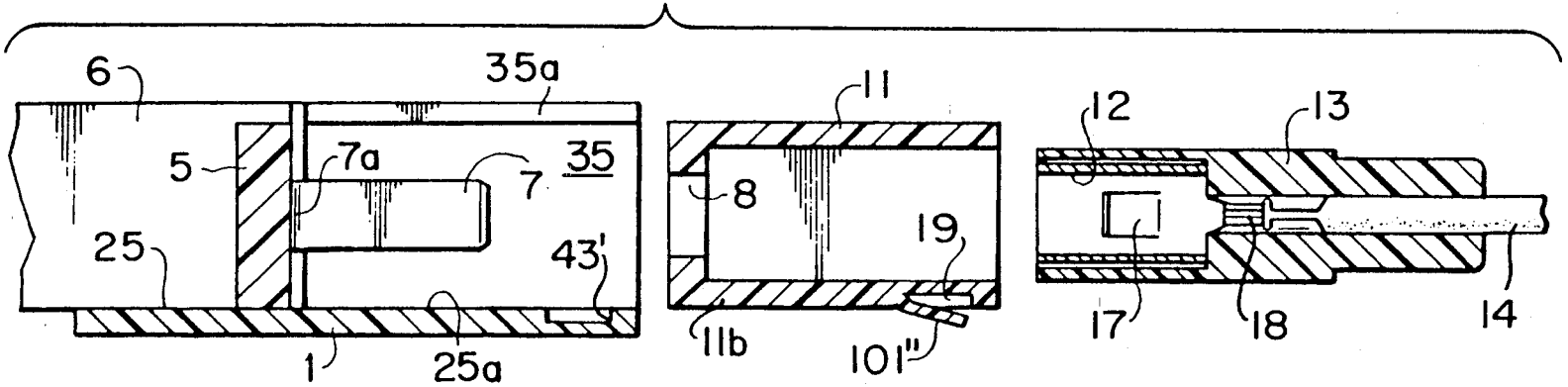
Figure 2F:
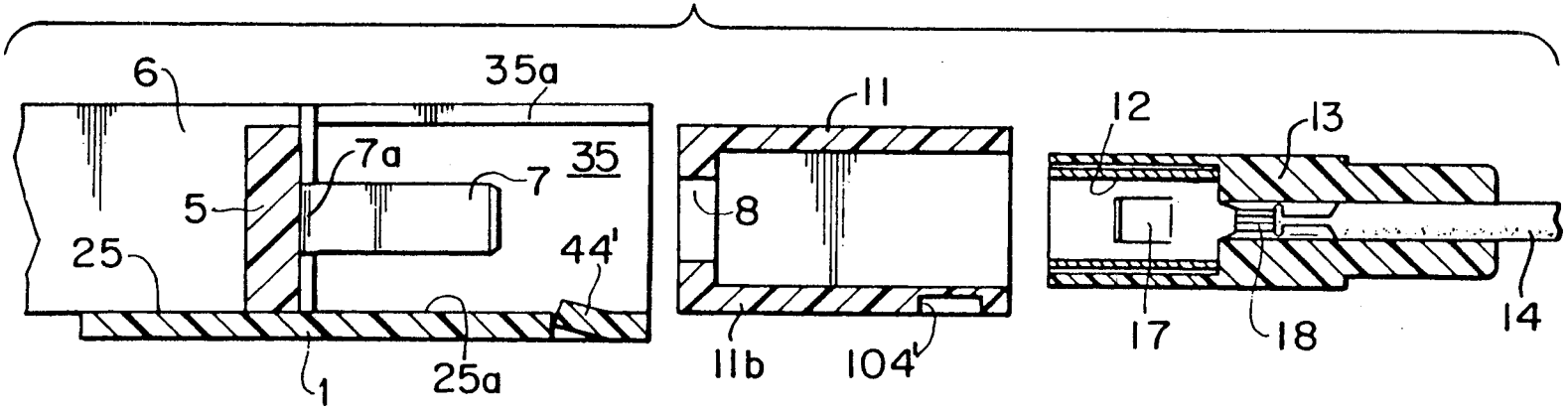

As shown perhaps more clearly in FIG. 2A, the tubular housing 11 defines openings 8 in its distal end wall **11*a*. These openings 8 are sized and configured so as to closely conform to the size and shape of the forwardly extending male terminals 7 and thereby allow the male terminals 7 to extend therethrough—i.e., so that the male terminals 7 are positioned within and housed by the interior of the tubular housing 11 when the latter is coupled to the base 1 (see FIGS. 7A and 8A, for example). The tubular housing 11 also includes an opposing mirror-imaged pair of generally L-shaped mounting legs 9 that establish longitudinally extending guide grooves 9*a*. The guide grooves 9*a* are sized and configured to accept a respective one of the rail edges 41 so as to allow relative sliding movements to occur between the tubular housing 11 and the base 1**.

The tubular housing 11 is also provided with a resiliently deformable tongue element 101 that extends downwardly from the bottom wall **11*b*. The resilient tongue element 101 is, moreover, slanted downwardly and forwardly relative to the tubular housing 11 and terminates in a forwardmost edge 101*a* (see FIG. 2A**).

Figure 3A:
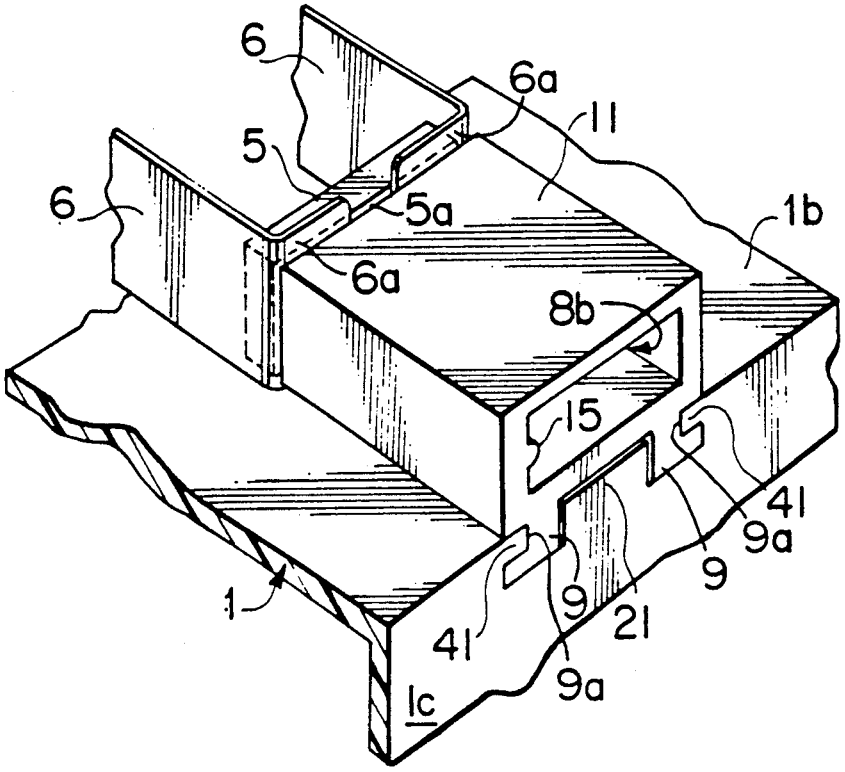
FIGS. 3A–3E are each respective perspective views of the electrical connector embodiments shown in FIGS. 1A–1E, but illustrated in a state in which the tubular housing is coupled to the base therof.
Figure 4A:
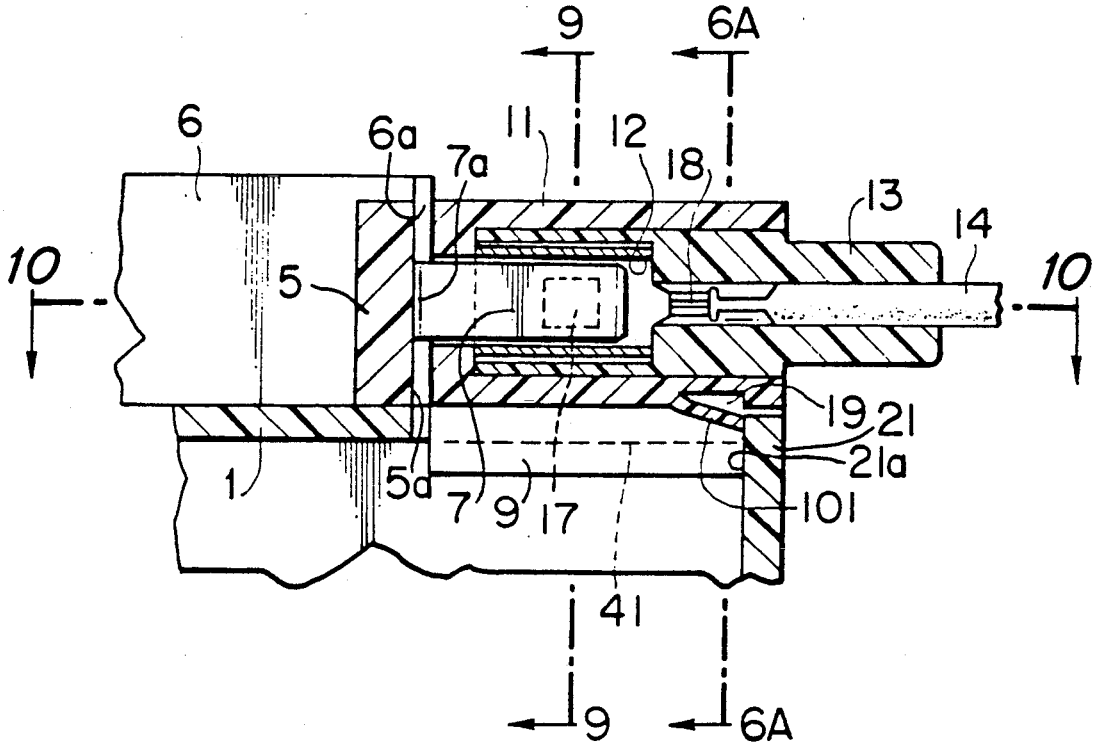
FIGS. 4A–4F are each vertical cross-sectional views of the connector embodiments shown in FIGS. 2A–2F, respectively, and illustrated in a state whereby the female plug body is inserted into the tubular housing (and thereby coupled electrically to the male terminals housed thereby)
Figure 7A:
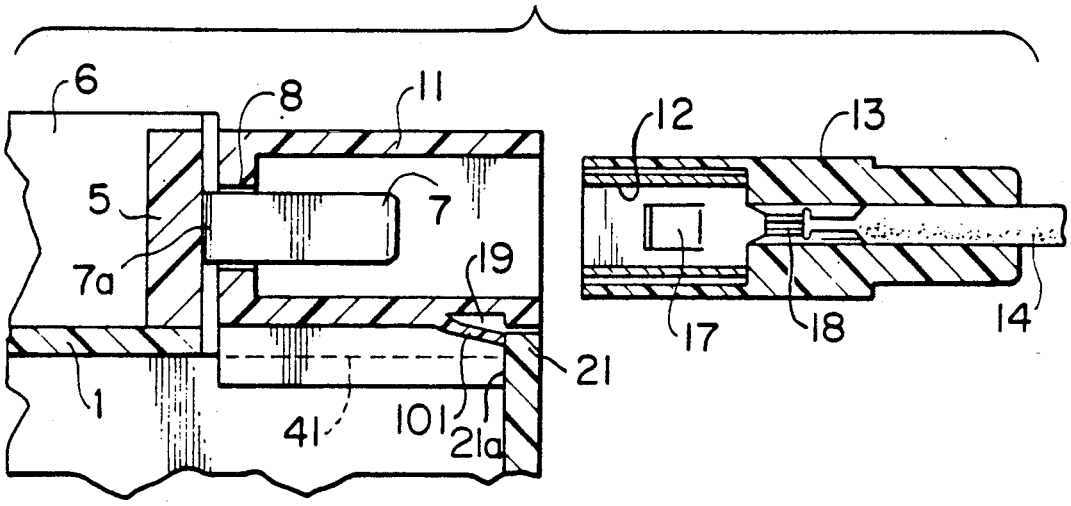
FIG. 7A is a side cross-sectional elevational view similar to FIG. 4A, but illustrated in a state whereby the female plug body is separated from the tubular housing.

As is shown particularly in accompanying FIGS. 4A and 7A, the fowardmost edge **101*a* of the tongue element 101 is engaged with the rear surface 21*a* of the stop plate 21 when the housing 11 is coupled to the base 1 (i.e., in a state as shown in FIG. 3A, for example). Because of this engagement between the stop plate's rear surface 21*a* and the forwardmost edge 101*a* of the tongue element 101, the tubular housing 11 will be retained in its coupled relationship with base 1—i.e., cannot normally be withdrawn away from the male terminals 7**.

In order to assemble the tubular housing 11 onto the base 1, the mounting legs 9 of the latter are aligned with the similarly configured slots 31 so that the rail edges 41 mate with the guide grooves 9*a*. The housing 11 may then be slidably moved rearwardly (i.e., in a direction towards the retaining wall 5) so that the male terminals 7 begin to enter the respective openings 8 formed in the rear wall 11*a* of the housing 11. Continued rearward sliding movement of the housing 11 will cause the upper edge of stop plate 21 to engage the forwardly and downwardly slanted resilient tongue element 101, causing the latter to be urged upwardly towards and into the recess 19 formed in the bottom wall 11*b* of housing 11.

With the housing 11 is in its "seated" position—i.e., with the rear wall of the housing 11 abutting those bent portions 6*a* of the conductive plates 6 on the forward face 5*a* of the retaining wall 5 as shown in FIG. 3A—the tongue element 101 will have cleared the rearward surface 21*a* of stop plate 21. As a result, the inherent resiliency of the tongue element 101 will thereby urge it to return to its "normal" position (i.e., where it is slanted downwardly and forwardly). Upon returning resiliently to its normal position, the forwardmost edge of the tongue element 101 will thus abut against the rearward surface 21*a* of the stop plate 21. The housing 11 will thereby be retained in its coupled relationship to the base 1 by virtue of this engagement between the tongue element 101 and the stop plate 21.

The rear wall 11*b* of housing 11 will moreover exert a rearwardly directed force against the base sections 7*a* of male terminals 7 which is maintained due to the interengagement of the tongue element 101 and the stop plate 21. Thus, the housing structure of the present invention not only protects the male terminals 7 due to the male terminals 7 being housed within the tubular housing 11, but also imparts structural rigidity to the male terminals 7 (and the conductive plates 6 associated therewith) due to the base sections 7*a* of the male terminals 7 being forcibly captured between the rear wall 11*b* of housing 11 and the forward surface 5*a* of retaining wall 5. In this manner, the conductive plates 6 does not necessarily need to be attached physically to the base 1 via separate fasteners—e.g., screws, rivets, etc.—since the tubular housing 11 provides these fastening functions.

It will be appreciated, therefore, that the tubular housing 11 can be coupled to the base 1 in a so-called "one touch" mounting manner (usually without the need of any tools) due to the snap-fitting relationship between the tongue element 101 and the stop plate 21. The housing 11, when coupled to the base 1, will therefore protectively house the forwardly projecting parallel male terminals 7.

With the housing 11 coupled to the base 1 as described above, the female plug body 13 (having female connecting terminals 12 corresponding in number to the male terminals 7) may then be inserted operatively within the opening 8*b* defined at the forward end of housing 11. In such a manner, the male terminals 7 are each electrically coupled to the female terminals 12, as shown more specifically in accompanying FIG. 4A.

Figure 8A:
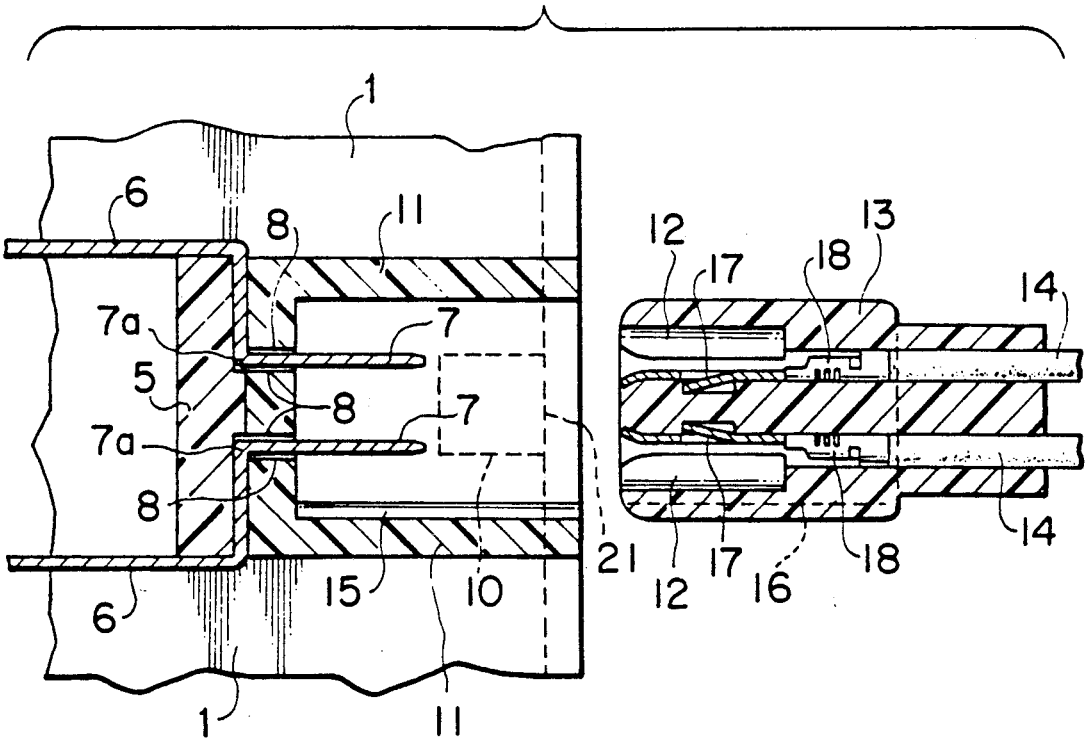
FIG. 8A is a top cross-sectional view of the connector shown in FIG. 7A as taken along line 8A–8A therein.
Figure 9:
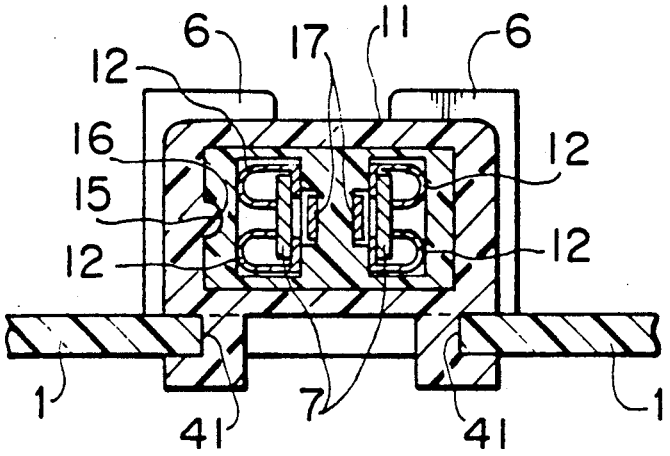
FIG. 9 is a collective cross-sectional view of the various electrical connector embodiments shown in FIGS. 4A–4F as taken along section line 9—9 therein.
Figure 10:
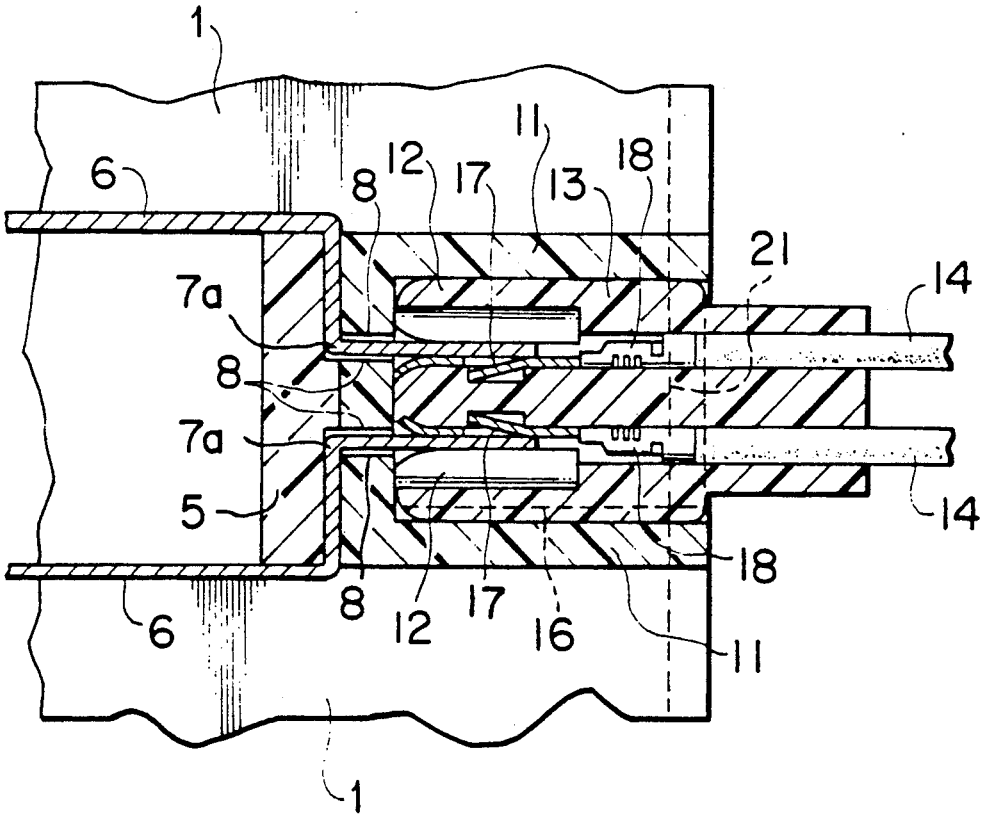
FIG. 10 is a collective lateral cross-sectional view of the various electrical connector embodiments shown in FIGS. 4A–4F as taken along section line 10—10 therein.
Figure 11A:
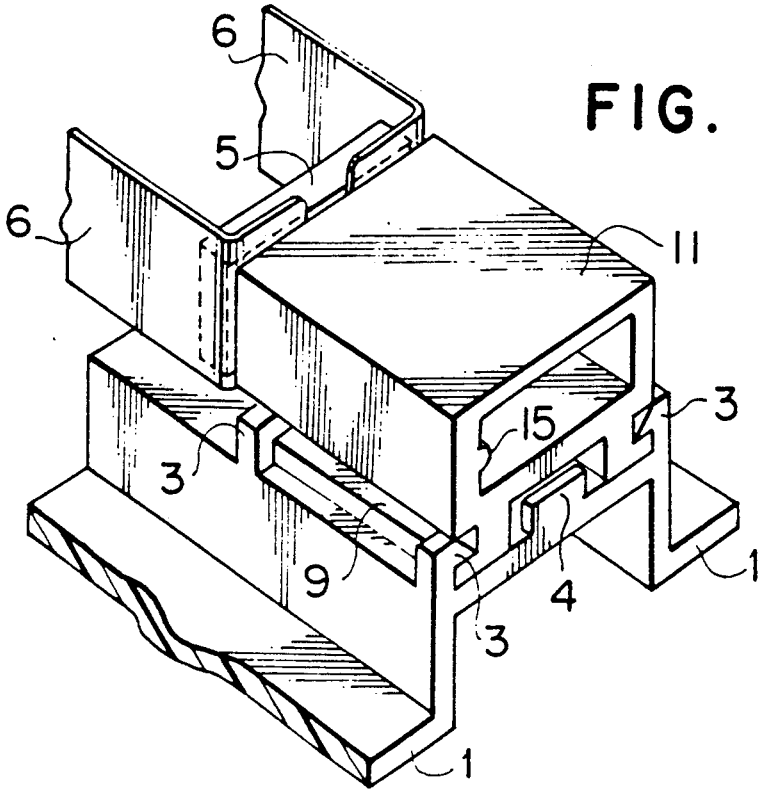
FIGS. 11A–11B are each perspective views of other embodiments according to the present invention showing the electrical connectors thereof in an assembled state.
Figure 11B:
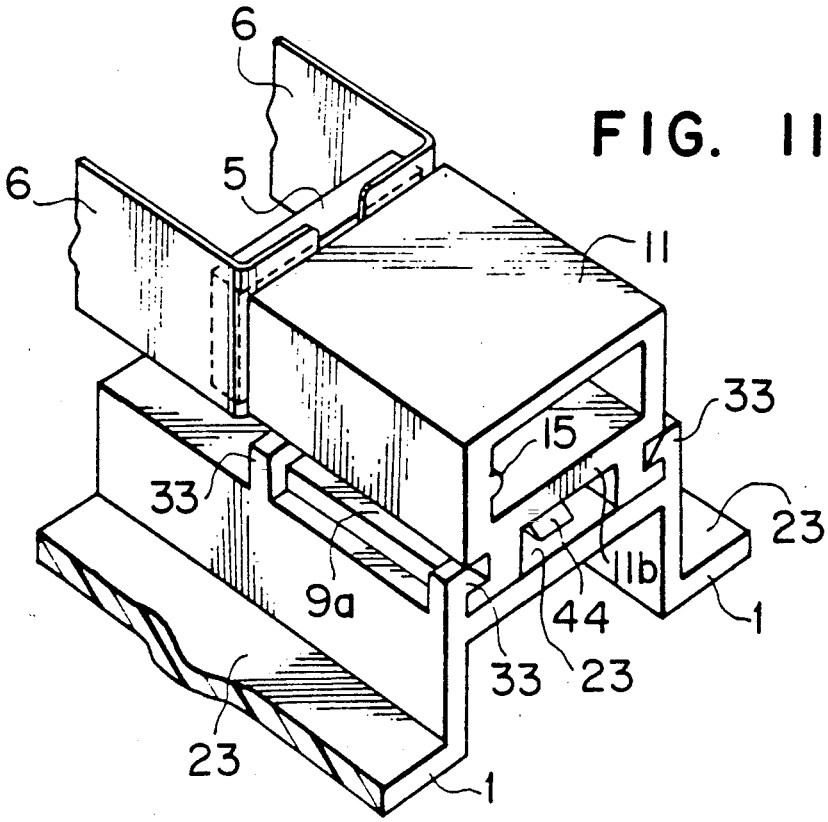
Figure 12A:
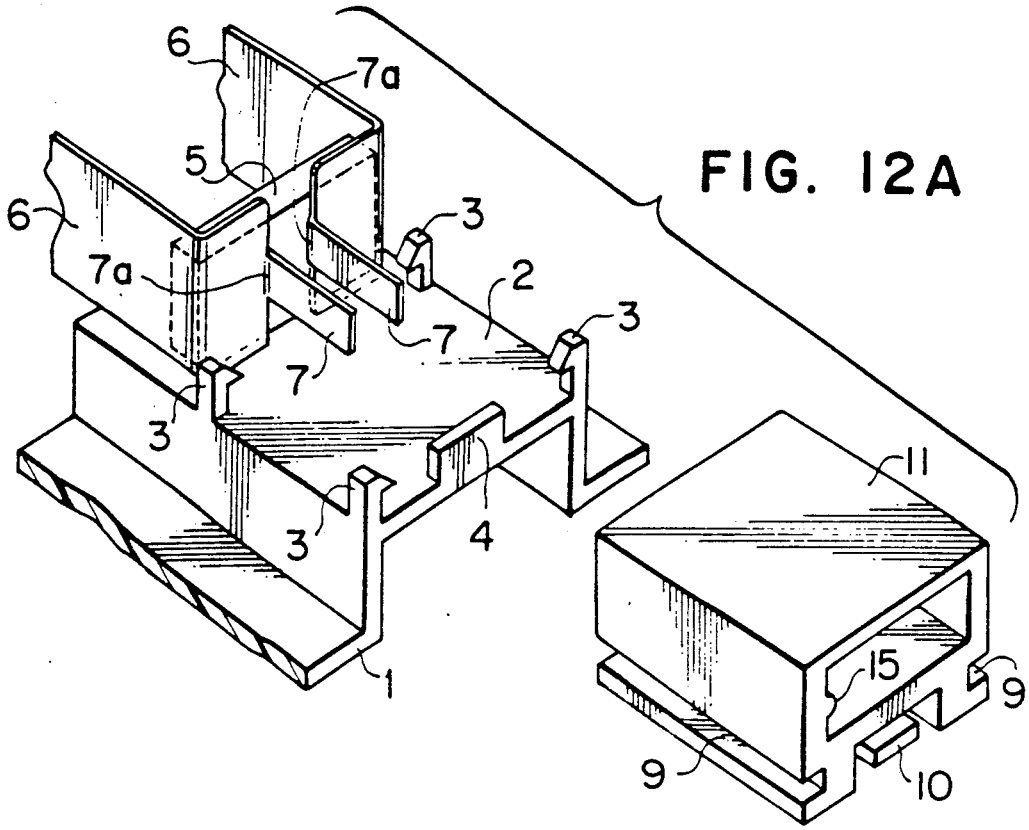
FIGS. 12A–12B are each perspective views of the respective electrical connectors shown in FIGS. 11A–11B but shown in a disassembled state thereof.
Figure 12B:
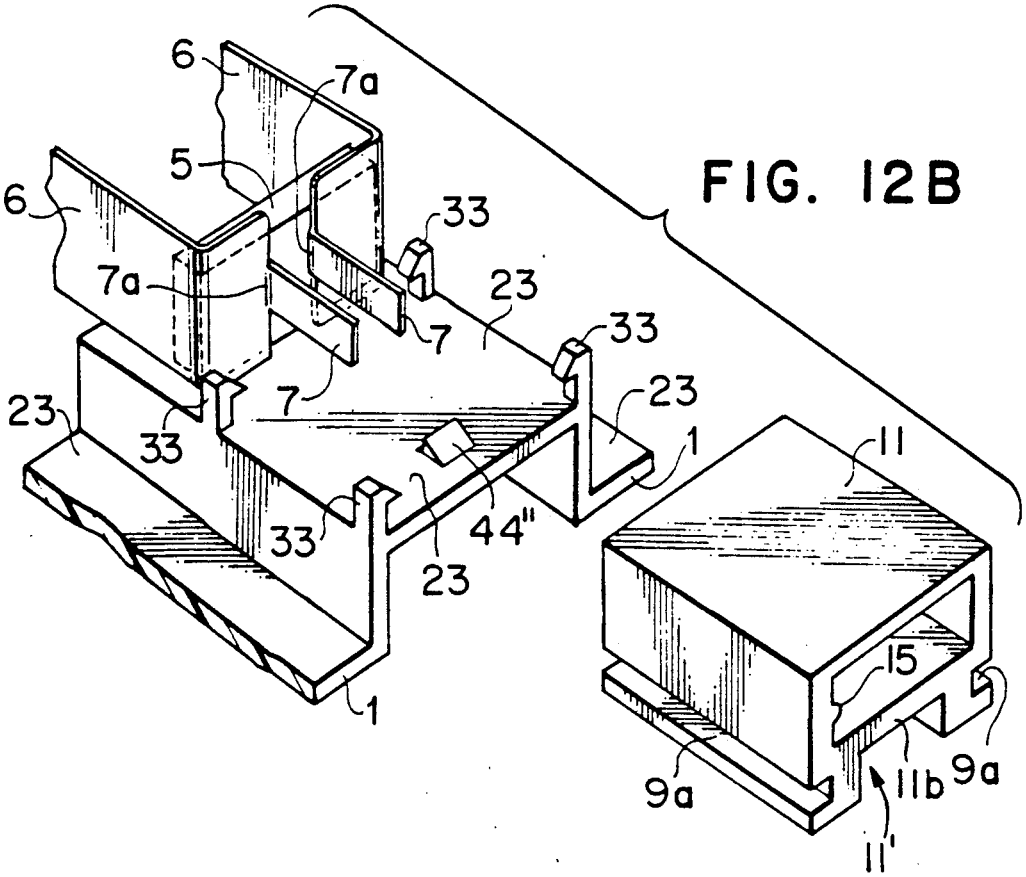
Figure 13A:
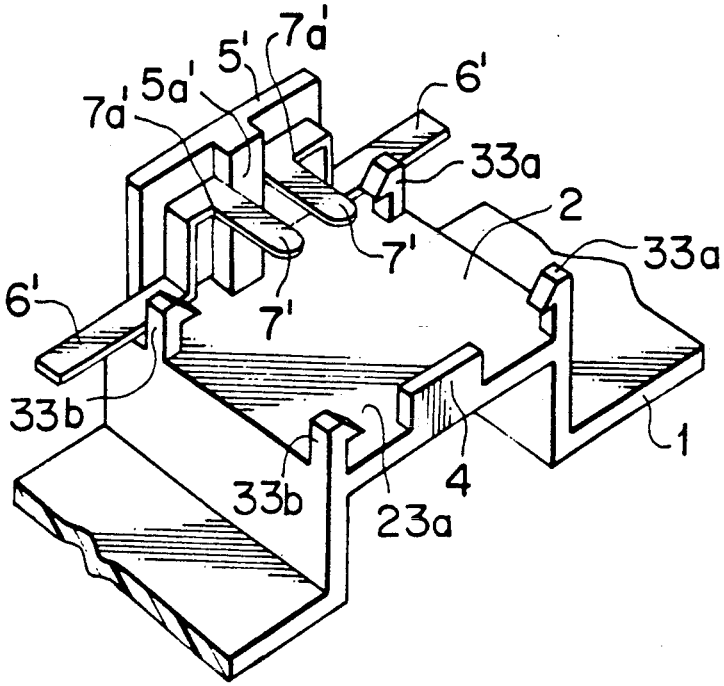
FIGS. 13A–13D are perspective views showing alternative embodiments of the base according to the present invention.
Figure 13B:
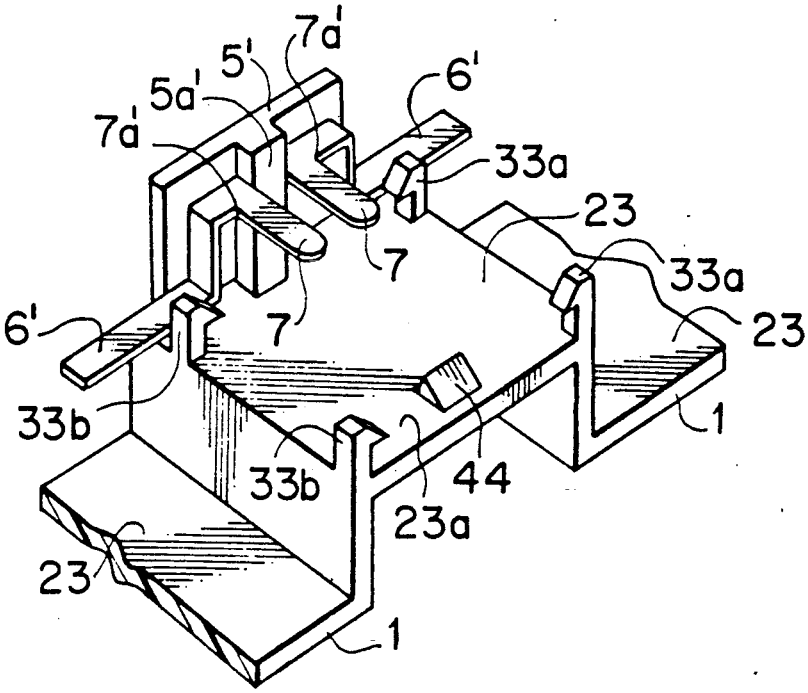
Figure 13C:
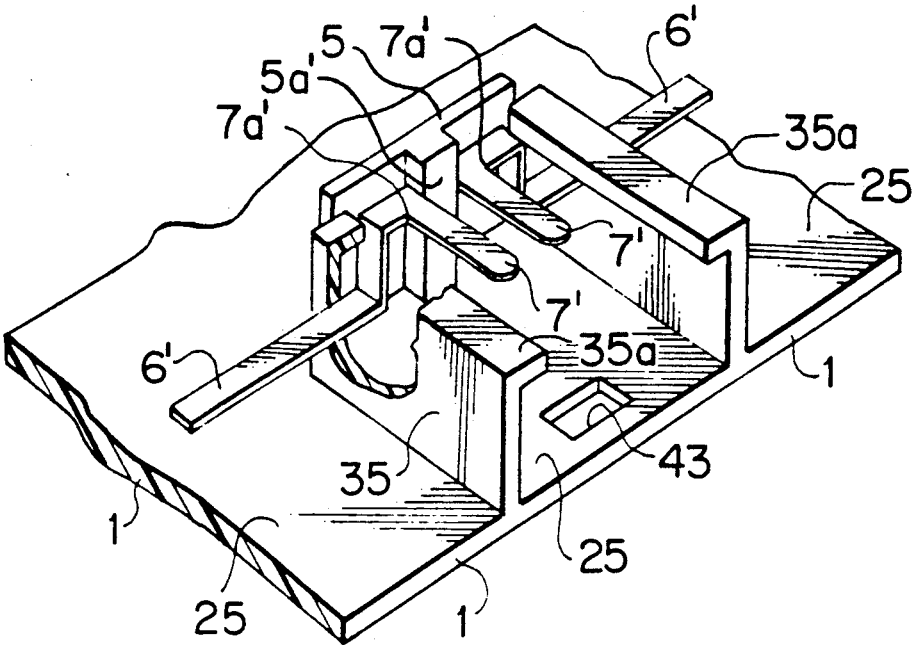
Figure 13D:
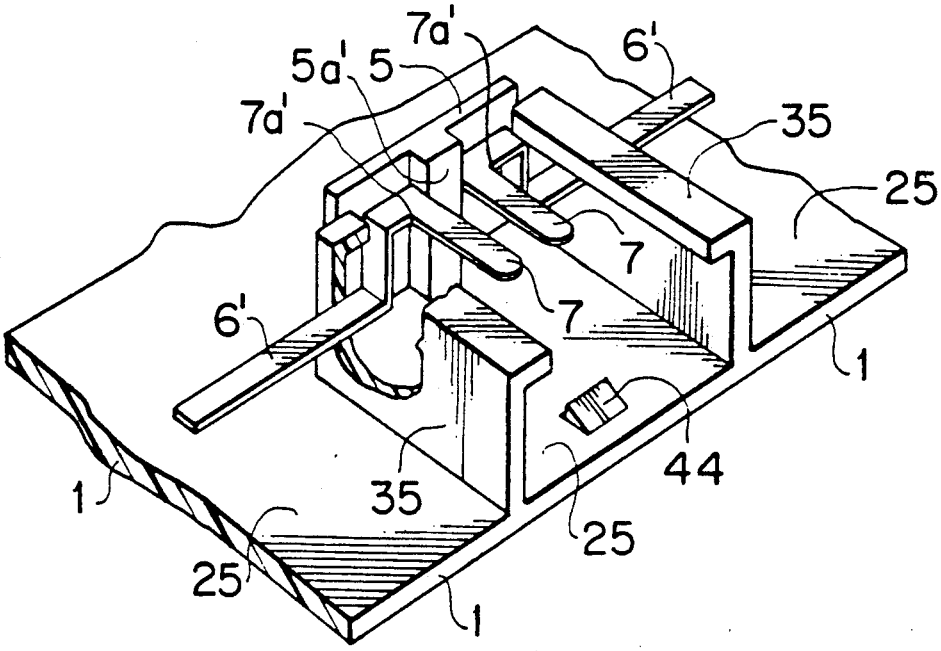

The female terminals 12 include a fastening claw 17 for securing the same within the female plug body 13 (the latter being formed of an electrically insulating plastics material, e.g., nylon 6,6) as shown more clearly in FIGS. 7A and 8A. Conductive wires 14 coated with an electrically insulating material are respectively connected to the female terminals 12 at a press connection portion 18 thereof (see FIGS. 7A and 8A). The elongated conductive plates 6 (bus bar) may be connected to an external circuit (not shown) due to the electrical communication that is established via the male terminals 7, female terminals 12, and conductive wire 14.

In order to ensure correct alignment of the female plug body 13 relative to the tubular housing 11 (e.g., so as to ensure that correct polarity of the established electrical connection ensues), the tubular housing 11 and female plug body 13 are provided with cooperating tongue and groove elements 15, 16, respectively. Thus, when the female plug body 13 is slidably inserted into the tubular housing 11, the tongue and groove elements 15, 16, respectively, will likewise mate. As such, only one coupling orientation of the female plug body 13 (and hence a single coupling orientation for the pairs of male/female terminals 7/12) relative to the tubular housing 11 is allowed.

Although the embodiment of the present invention discussed above has been described in terms of a pair of male connecting terminals 7 which are formed from a pair of conductive plates 6, more or less numbers of male terminals 7/conductive plates 6 may be provided without departing from the scope of the present invention. In this regard, the number of female terminals 12 that are provided in the female plug body will usually coincide with the number of male terminals 7. Moreover, the precise external shape of the tubular housing 11 will be determined in large part by the numbers of male/female terminals 7/12, respectively, that are provided. Hence, the use of a square tubular form of the housing 11 and a mateably configured female plug body 13 are merely preferred for the embodiments of the present invention, and are thereby representative of the other geometric forms that the electrical connectors EC according to the present invention may take.

Another embodiment according to the present invention is shown in FIGS. 1B–6B. In this regard, the reader will note that many of the structures associated with this embodiment (and the other embodiments of the invention to be discussed below) are essentially the same as those described above with reference to FIGS. 1A–8A. Hence, these similar structures will not be described again in detail here. Instead, the discussion that follows will emphasize the structural and functional differences as between the various embodiments. Suffice it to say that similar structures as between all of the embodiments of this invention to be discussed herein bear the same reference numerals throughout the various FIGURES.

Figure 1B:
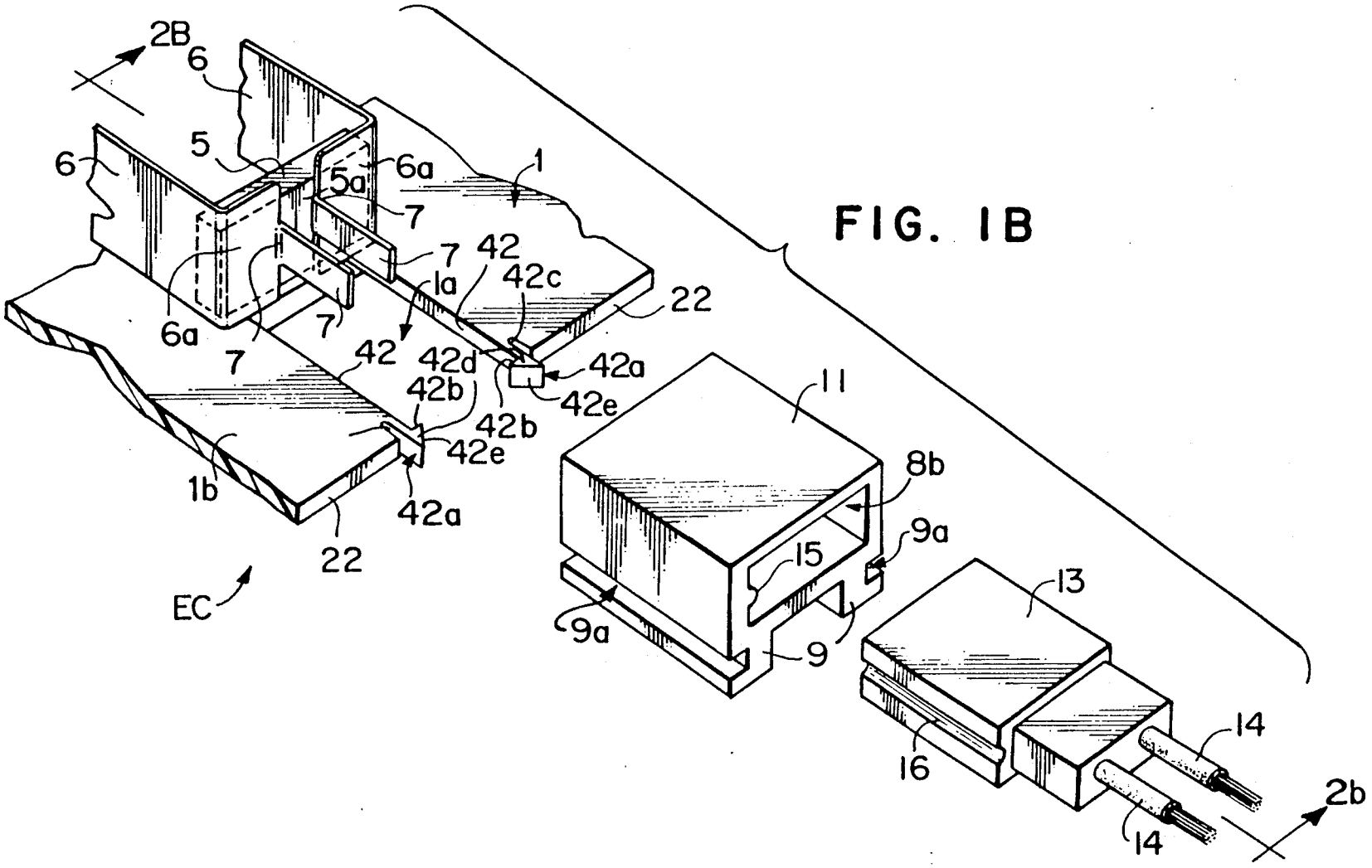
Figure 1C:
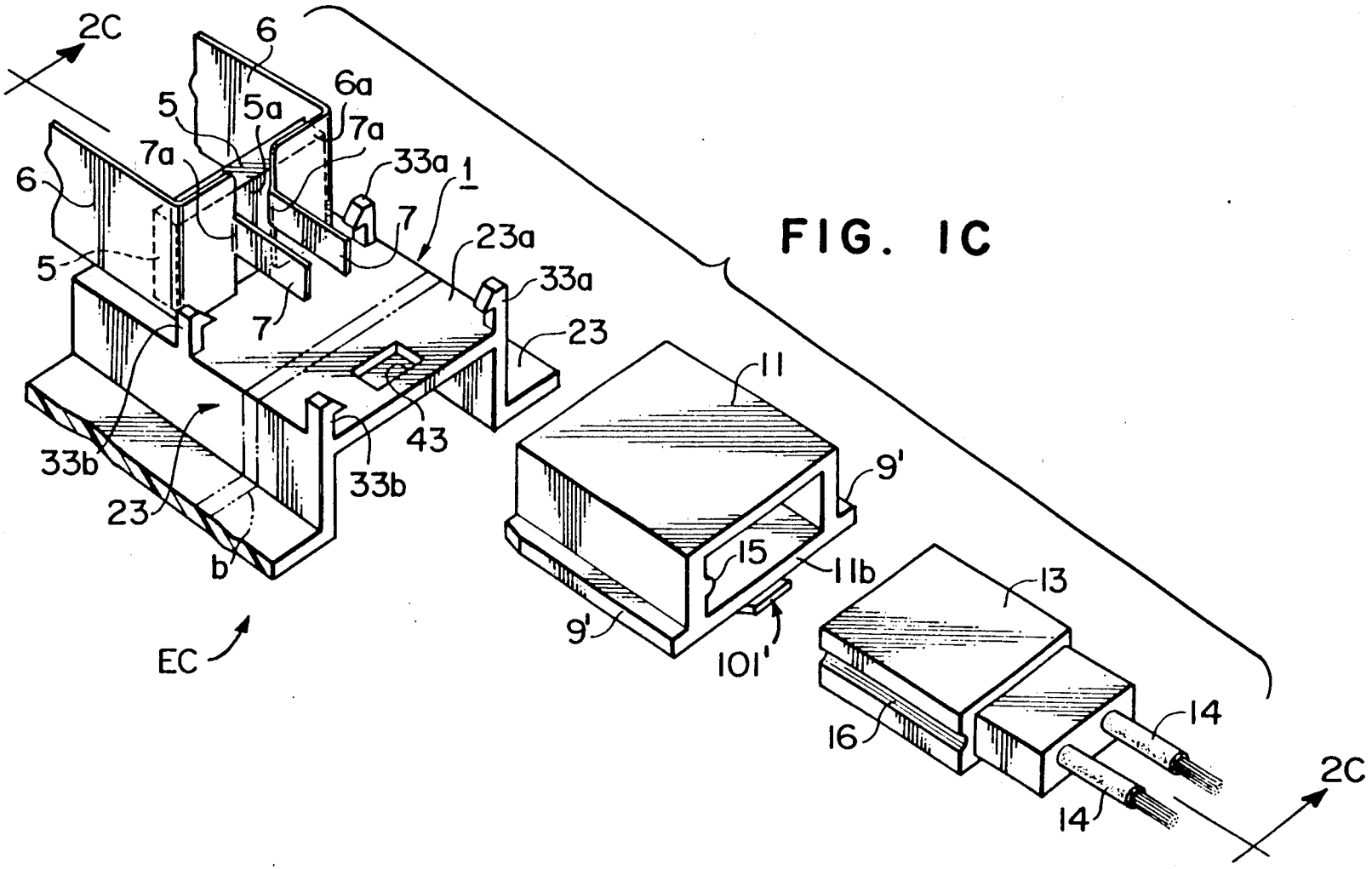

As is seen particularly in FIG. 1B, a pair of separated parallel rail edges 42 are formed in the insulating base 1. Each of the rail edges 42 integrally includes at the forwardmost end thereof, a laterally resilient tongue element 42*a*. The tongue elements each include an interior engagement surface 42*b* that is substantially aligned (i.e., coplanar) with the forward edges 22 of base 1 laterally of opening 1*a*. A relief slot 42*c* defined in the base 1 laterally of each of the fastening members 42*a* creates a longitudinally extending arm 42*d* parallel to the guide rails 42 that imparts lateral resiliency to the tongue element 42. As a result, each of the tongue elements 42 may be flexed resiliently outwardly relative to the other of the tongue elements 42 (i.e., so as to enlarge the separation dimension therebetween).

Figure 3B:
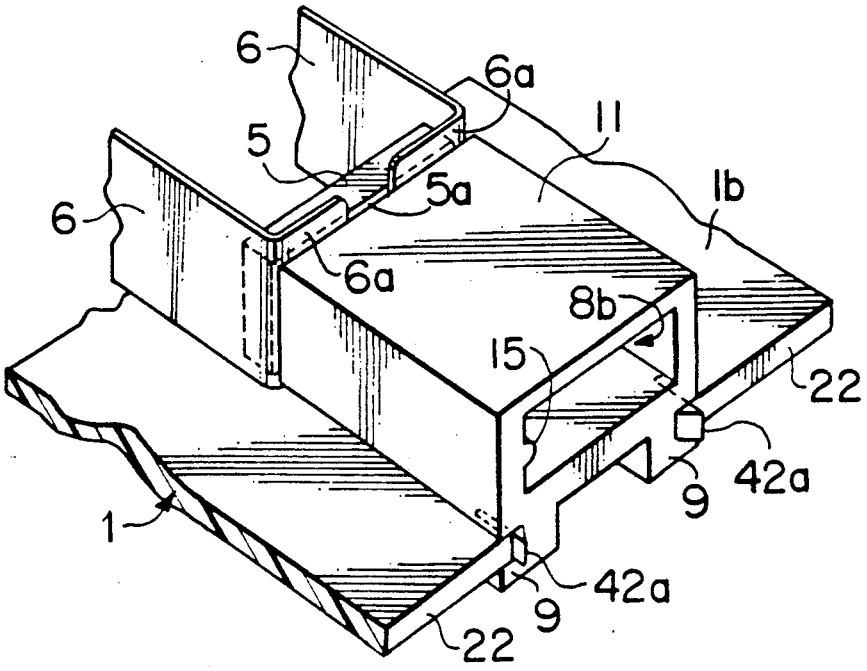
Figure 3C:
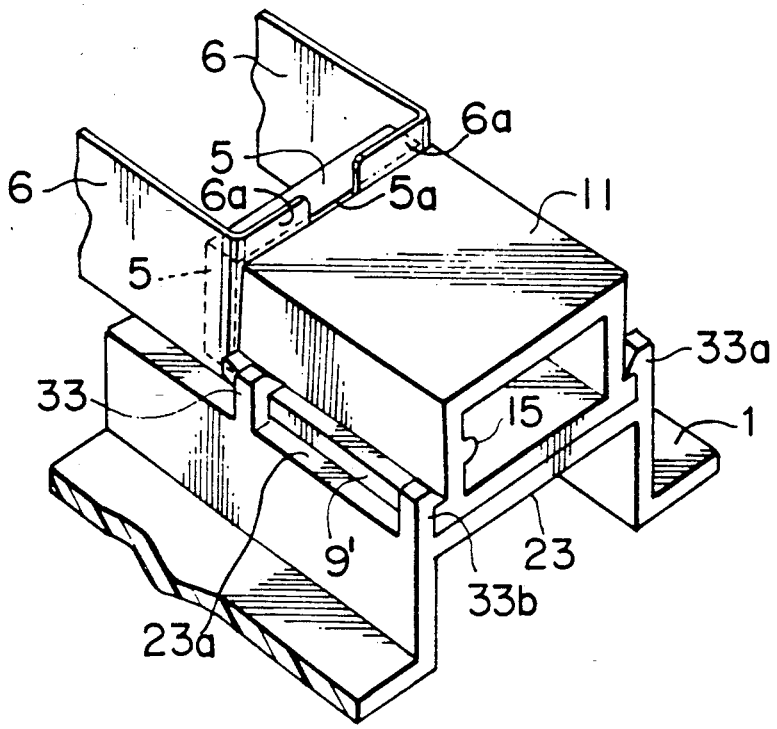
Figure 3D:
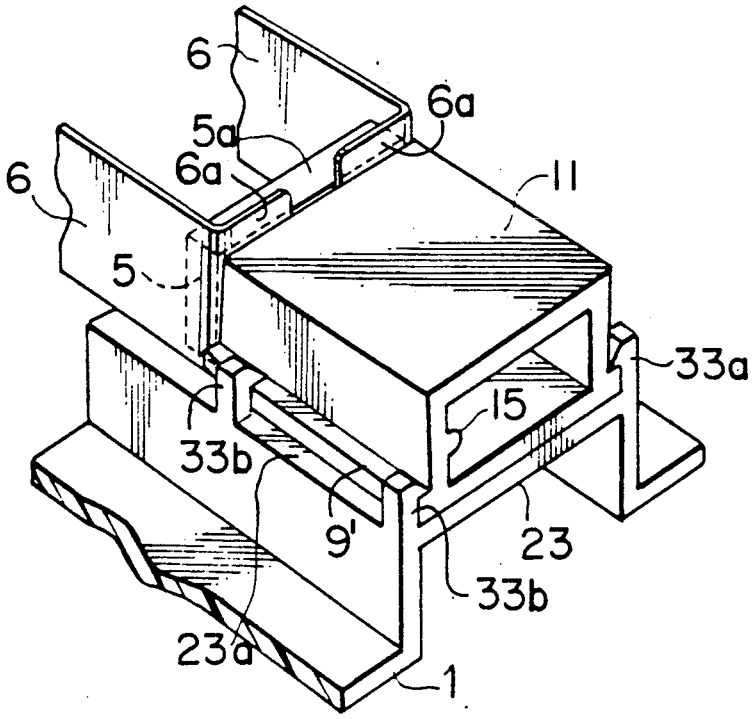
Figure 3E:
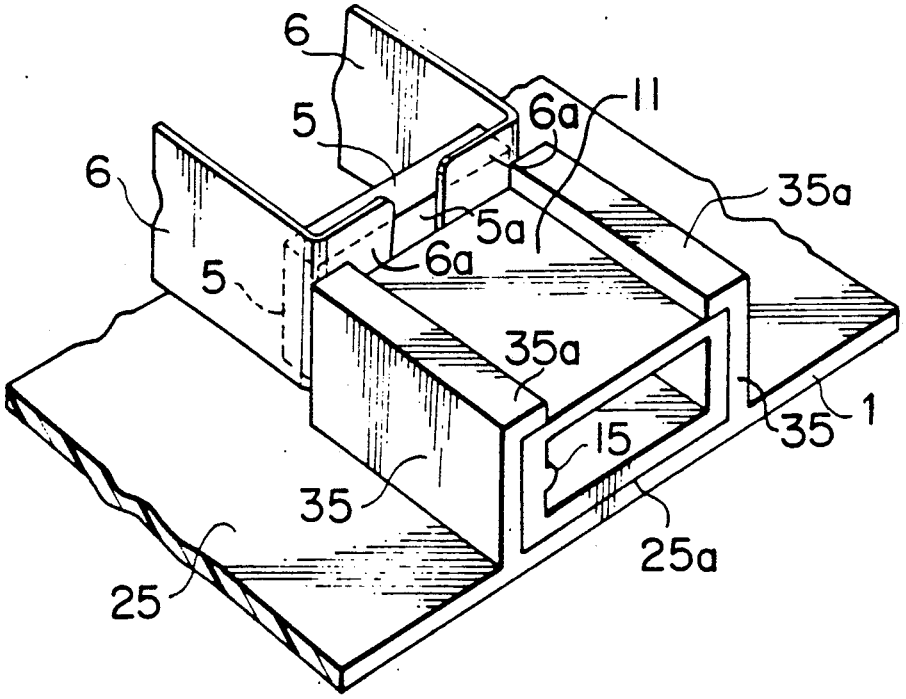
Figure 4B:
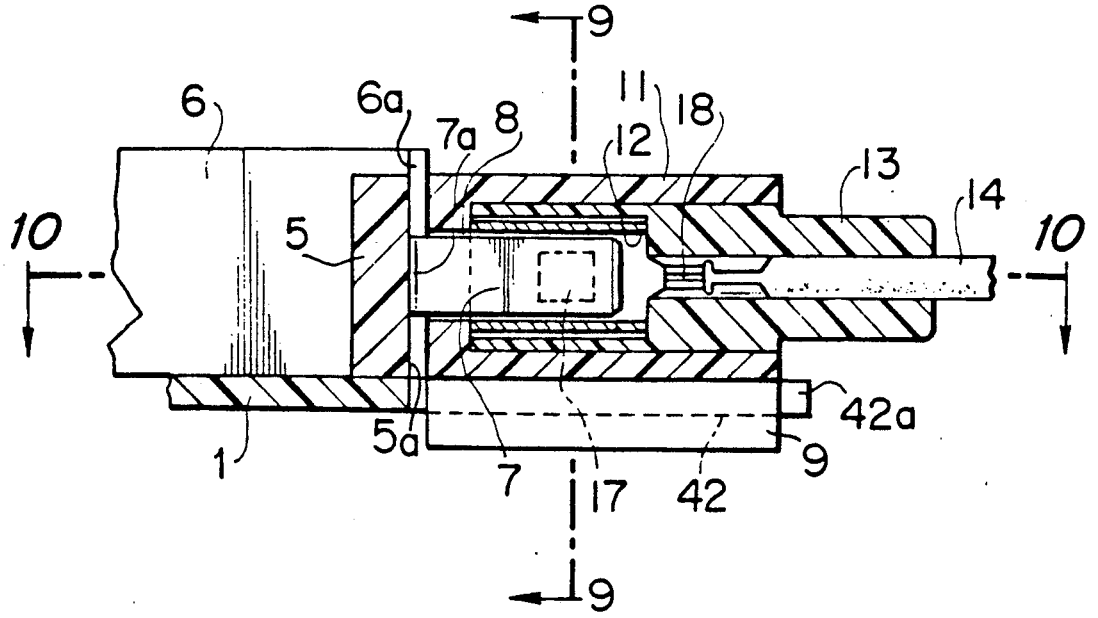
Figure 4C:
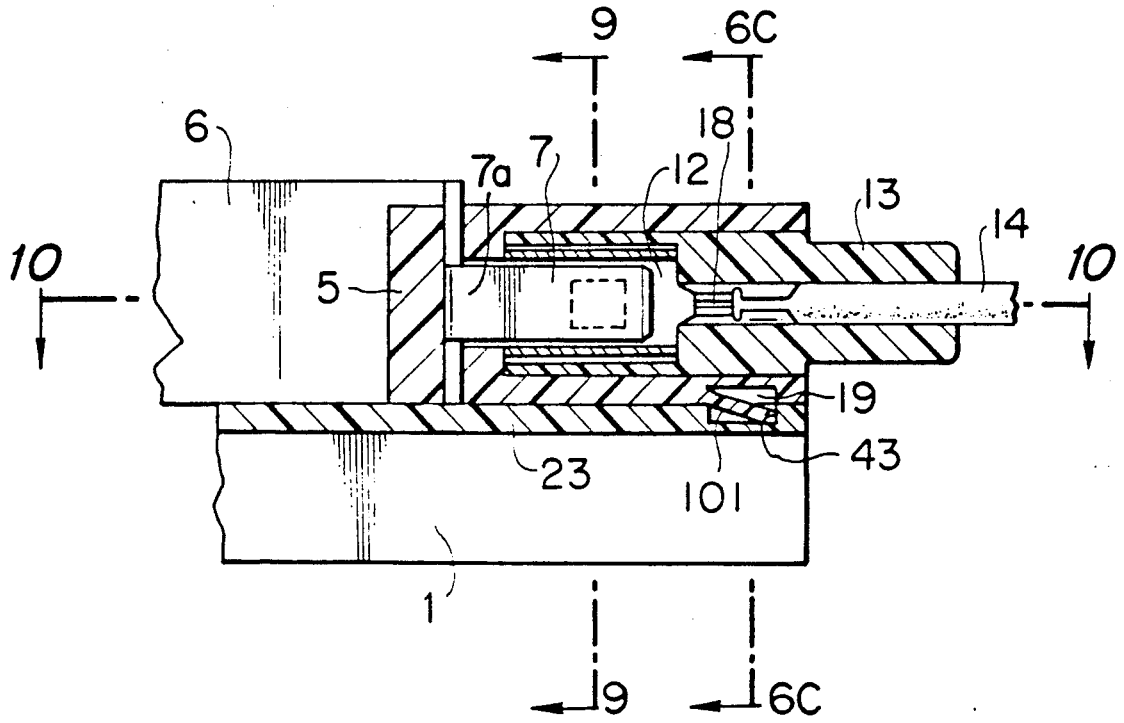
Figure 4D:
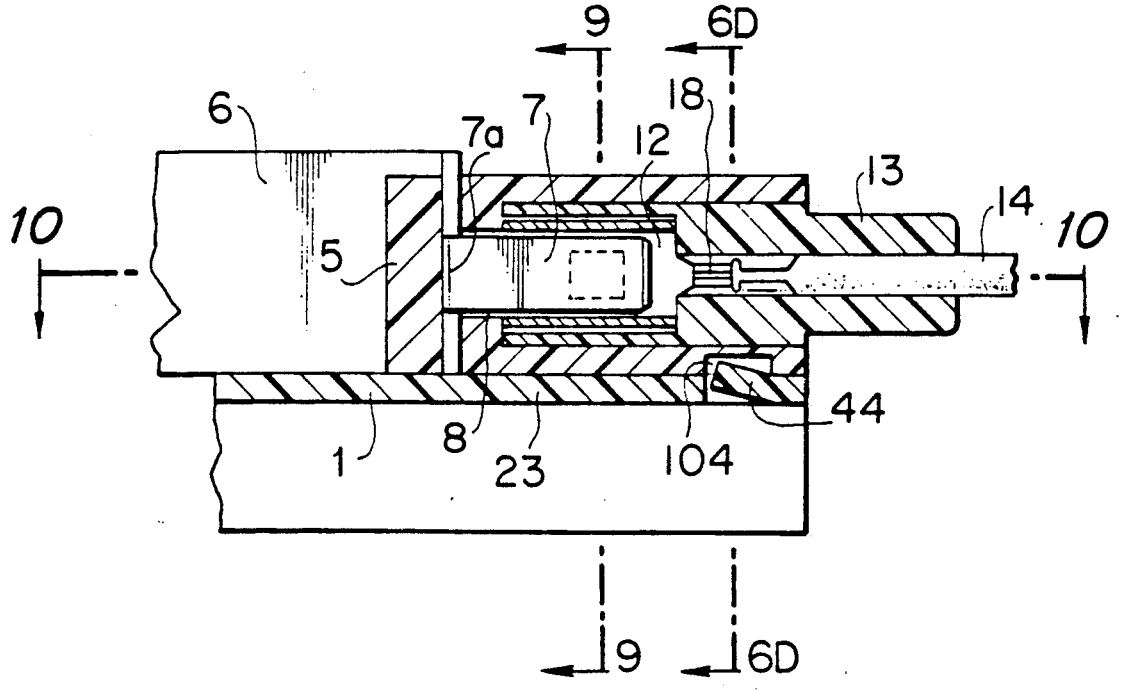
Figure 4E:
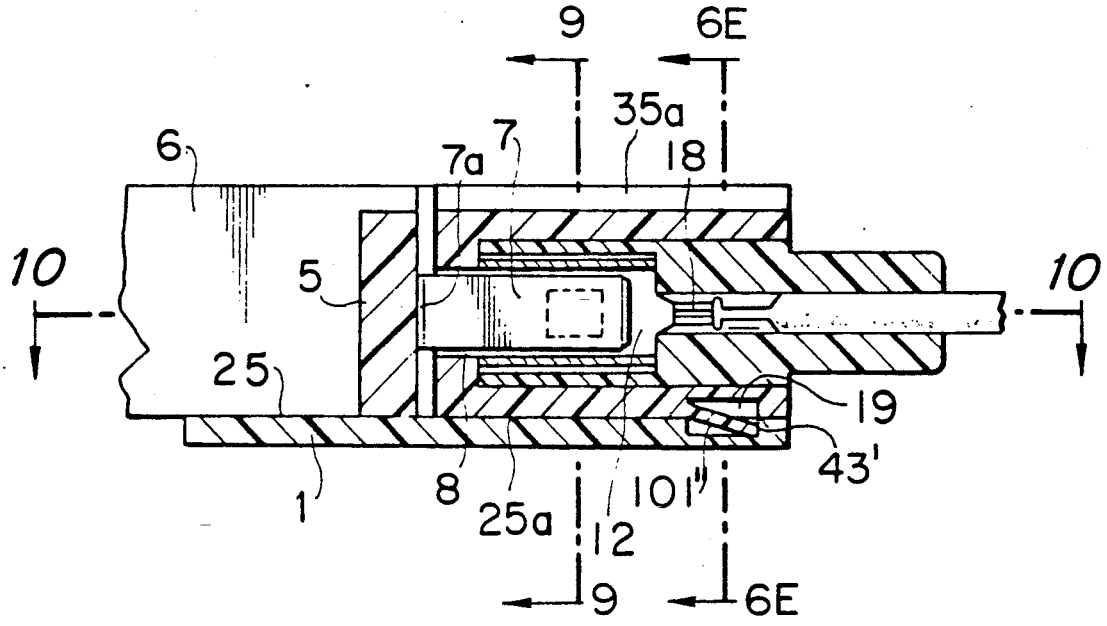
Figure 4F:
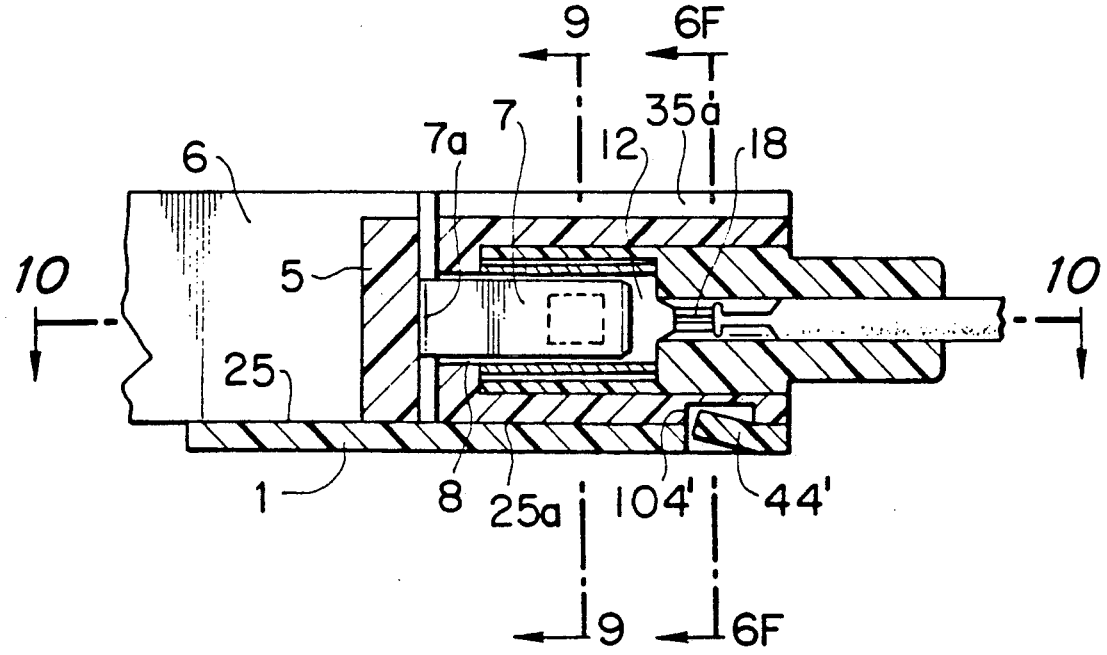
Figure 5A:
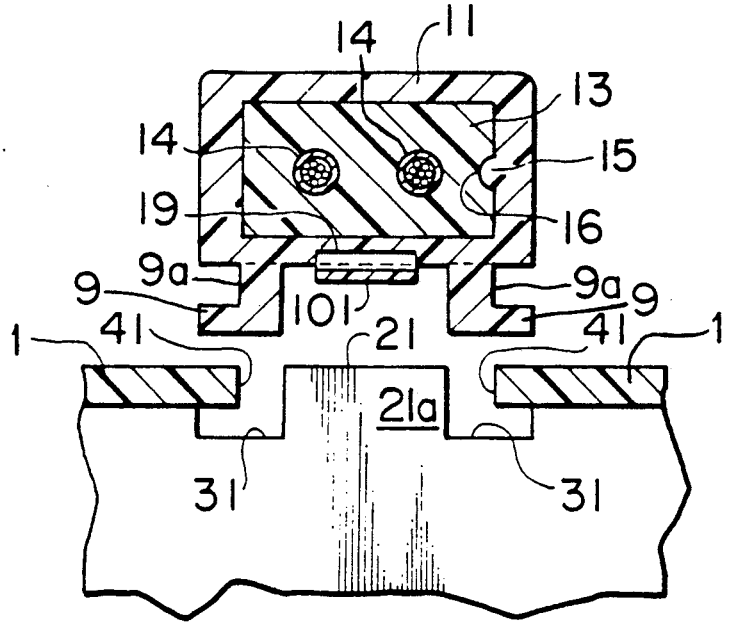
FIGS. 5A–5F are each cross-sectional views of the connectors shown in FIGS. 2A–2F, respectively, and illustrated in a state whereby the base is separated form the tubular housing.
Figure 5B:
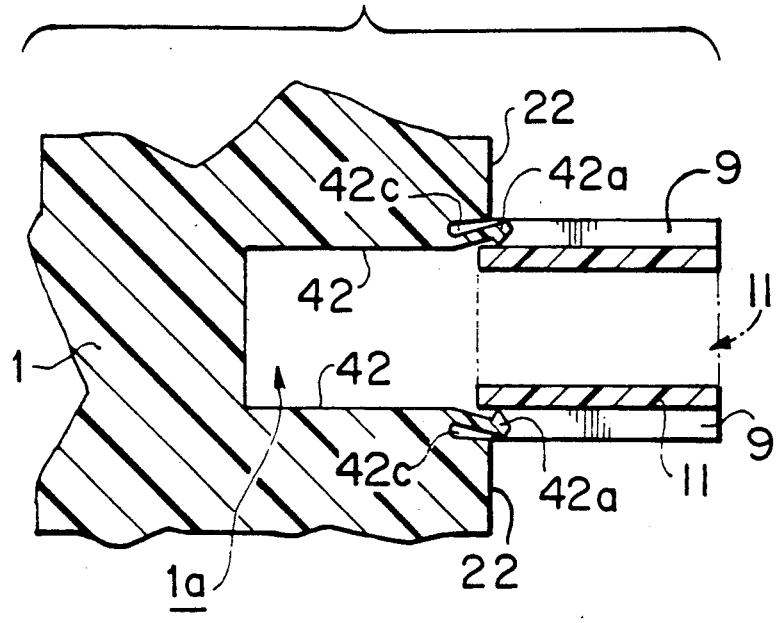
Figure 5C:
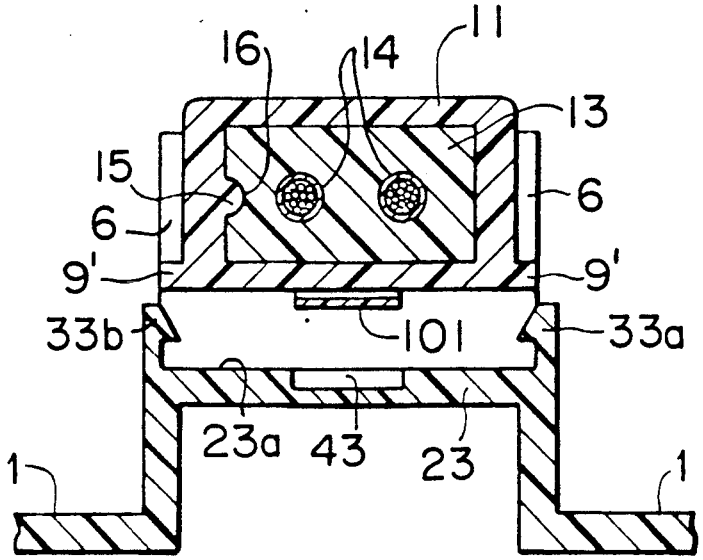
Figure 5D:
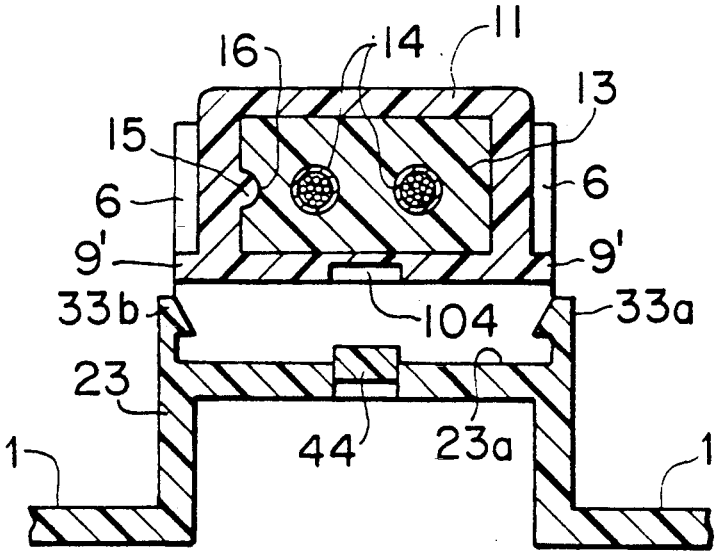
Figure 5E:
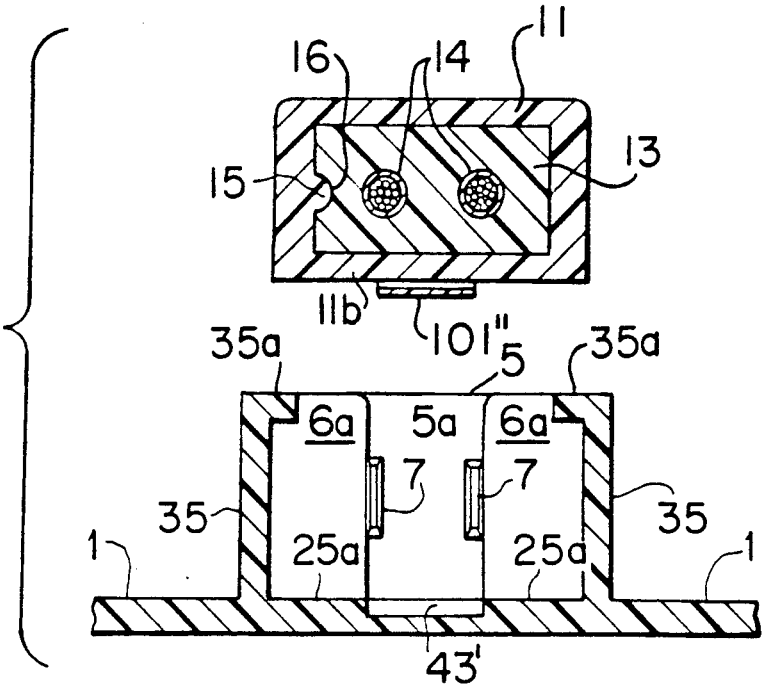
Figure 5F:
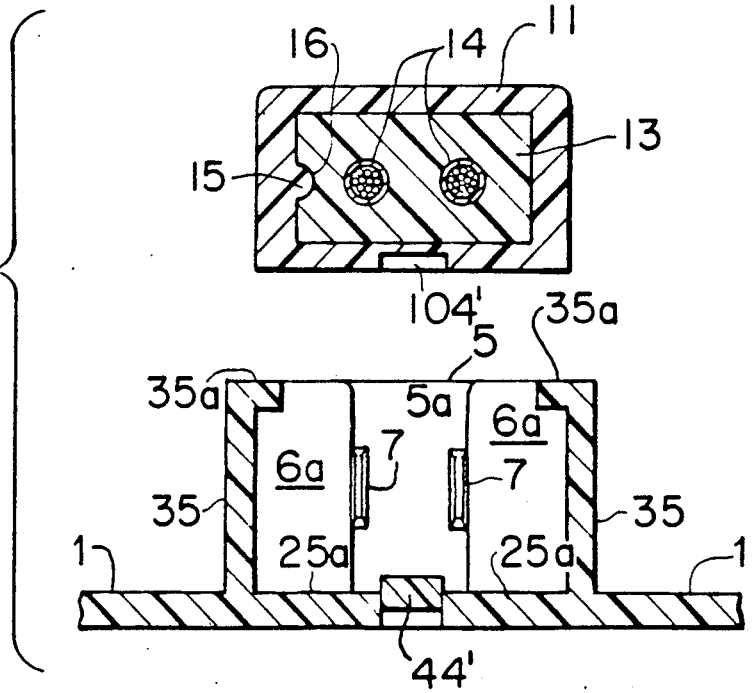

The tubular housing 11 may thus be coupled to the base 1 by aligning the rail edges 42 and the respective grooves 9*a* formed by the mounting legs 9. In this regard, it will be observed from FIG. 1B that a pair of outwardly divergent surfaces 42*e* are also defined on the tongue elements 42*a*. These surfaces 42*e* serve as cam surfaces of sorts so as to assist in the spreading of the tongue elements 42*a* during mounting of the tubular housing 11 onto the base 1. That is, when the rearward end of the tubular housing 11 contacts the surfaces 42*e*, the surfaces 42*e* will serve to assist in resiliently spreading the tongue elements 42*a* apart—i.e., due to the presence of the relief slots 42*c* and the arms 42*d* as described above. This state of coupling the housing 11 to the base 1 is perhaps more clearly shown in FIG. 5B. As a result, the column member 11 may be slidably moved into its final position—i.e., with the male connecting members being housed within the column member 11—as is shown in FIGS. 3B and 4B.

It will be observed that, with the tubular housing 11 in its seated position on the base 1, the tongue elements 42*a* will each return to their "normal" condition by virtue of their inherent resiliency. As a result, the engagement surfaces 42*b* thereof are brought into engagement with a portion of the forward face of the tubular housing 11 (see FIG. 3B, for example). In such a manner, the base sections 7*a* of the male terminals 7 are each securely captured between the rear wall 11*a* of the tubular housing 11 and the vertically extending retaining wall 5 in a manner similar to that as described above.

A modified embodiment of an electrical connector EC according to the present invention is shown in accompanying FIGS. 1C–6C. As shown particularly in FIG. 1C, the electrically insulating base 1 is provided with a raised platform section 23 which defines an upper supporting surface 23*a*. A centrally located recess 43 is defined in the supporting surface 23*a* near the forward edge of base 1.

The base 1 is also provided with opposing pairs of upright claw posts 33*a*, 33*b* which collectively establish a planar space above the surface 23*a* sized to closely accept the laterally projecting flange 9' of the tubular housing 11. The flanges 9' of the tubular housing 11 will thus be held securely against the bottom surface 23*a* of base 1 by means of the claw post pairs 33*a*, 33*b*. A forwardly and downwardly projecting resilient tongue element 101' is provided on the bottom wall 11*b* of the tubular housing 11 as is perhaps best seen in FIG. 4C.

The tubular housing 11 is coupled to the base 1 by aligning the laterally extending flanges 9' with the planar space established by the claw posts 33*a*, 33*b*, and by sliding the flanges 9' thereunder. The portion of the supporting surface 23*a* forwardly of the recessed surface 43 will thus engage the tongue element 101' during initial sliding movements of the tubular housing 11 onto the base 1, causing the tongue element 101' to be resiliently displaced upwardly into the recess 19 formed in the bottom wall 11*b* of the tubular housing 11. However, once the tongue element 101' has cleared this forward portion of the supporting surface 23*a*, it will return to its "normal" condition under the influence of its inherent resiliency as shown particularly in FIG. 4C. As a result, the forwardmost edge 101*a'* of tongue element 101' will engage the forwardmost edge of the recessed surface 43 in the support surface 23*a*. As a result, the tubular housing 11 is prevented from being withdrawn from the base 1. In addition, the base sections 7*a* of the male terminals 7 will be securely captured between the rear wall 11*a* of the tubular housing 11 and the vertical retaining wall 5 in a manner similar to that described previously.

Figure 1D:
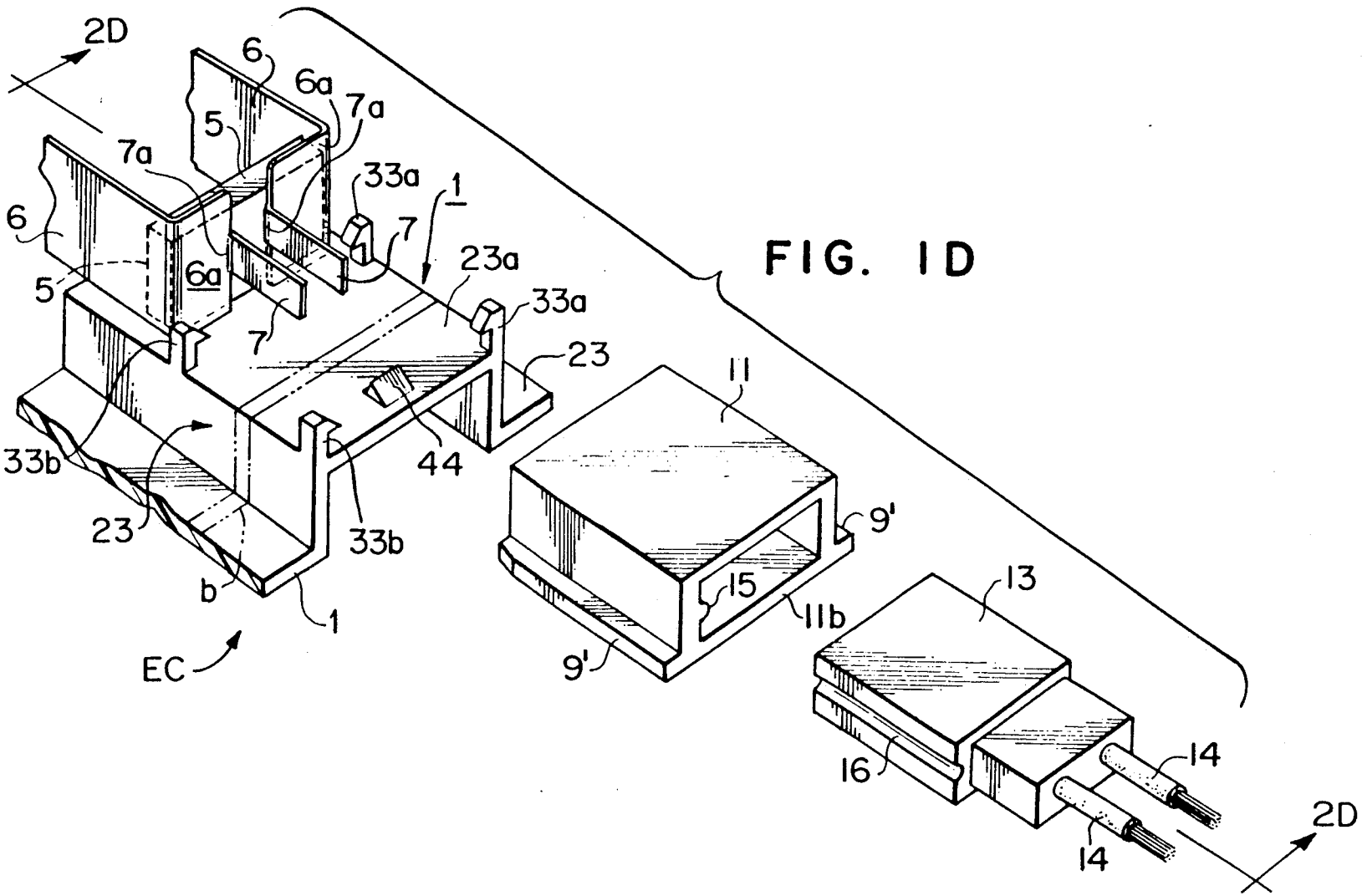
Figure 1E:
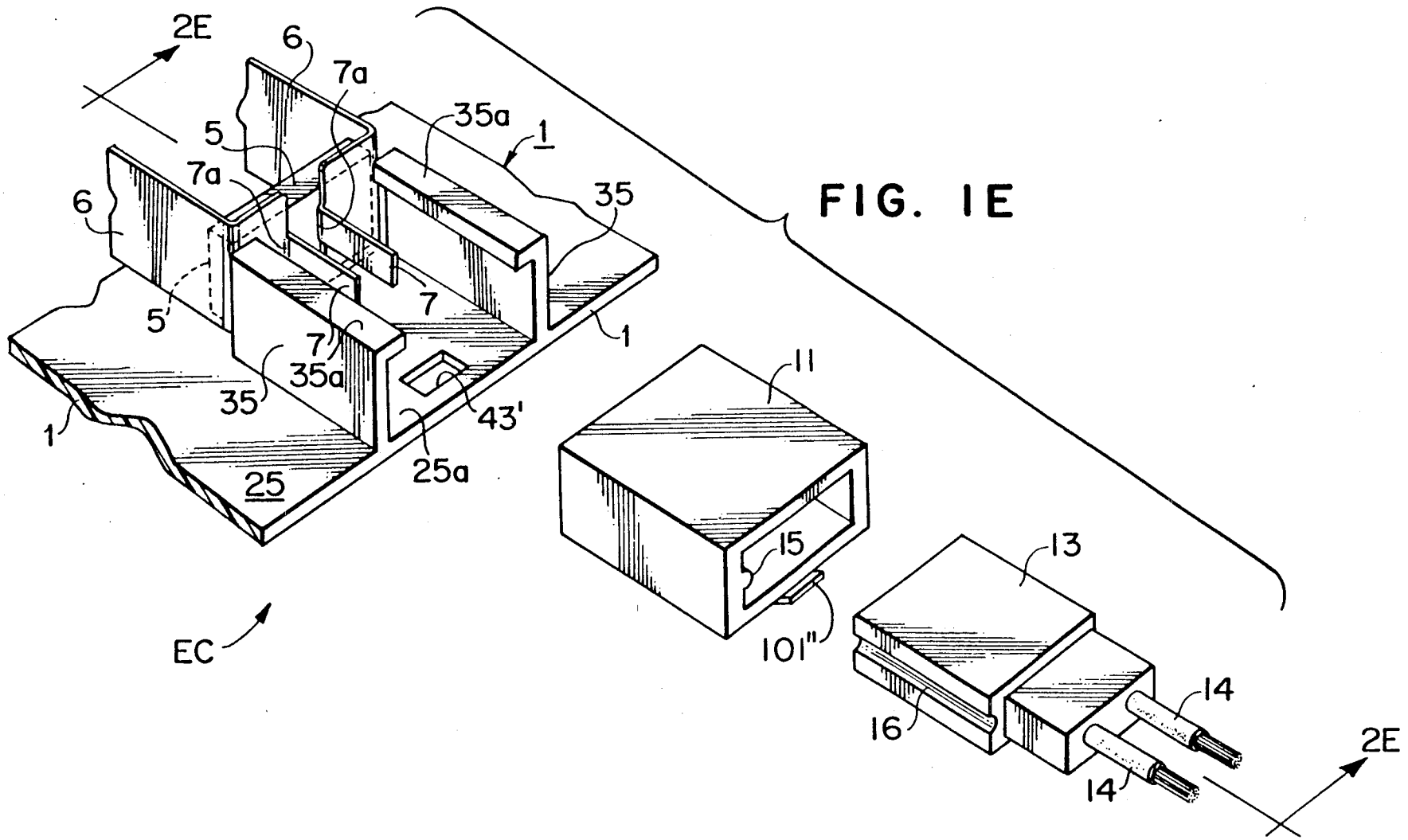
Figure 1F:
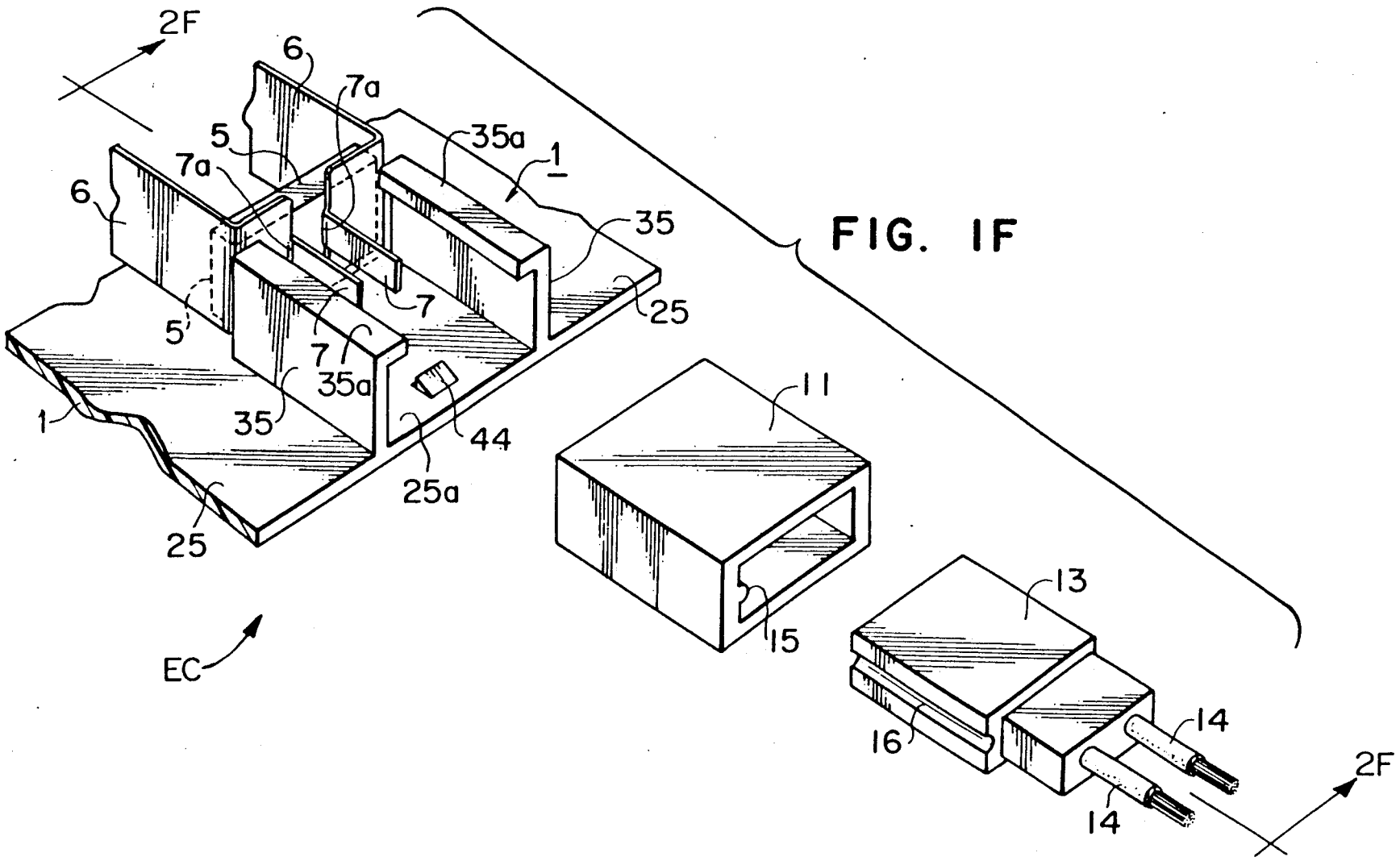
Figure 6A:
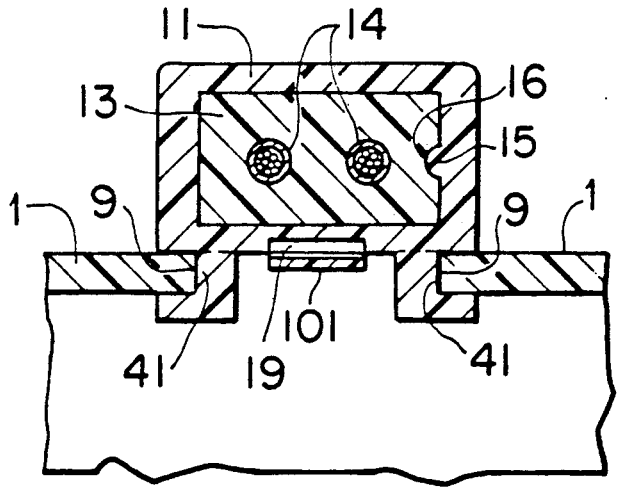
FIGS. 6A–6F are each elevational cross-sectional views taken along respective sectioning lines in each of FIGS. 4A–4F.
Figure 6B:
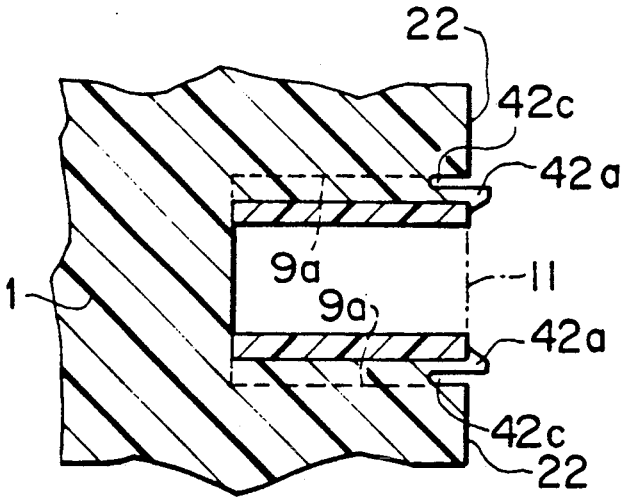
Figure 6C:
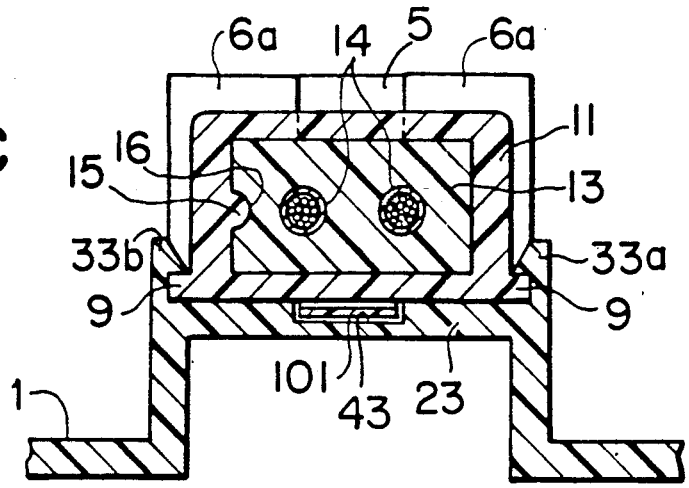
Figure 6D:
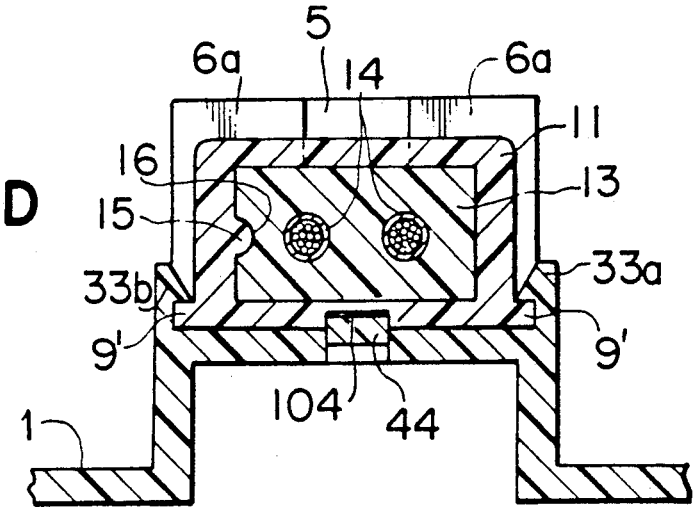
Figure 6E:
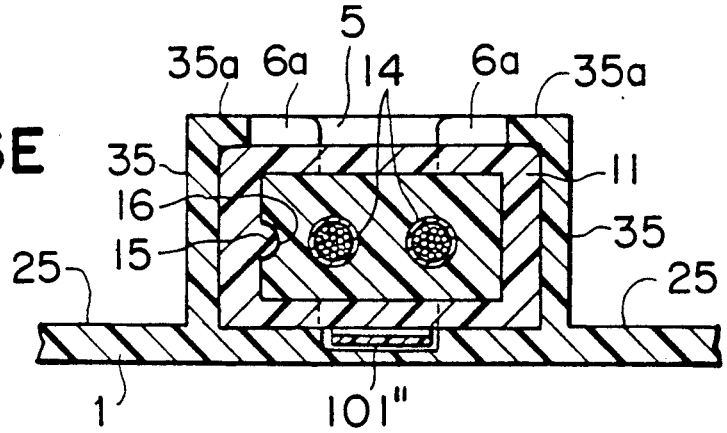
Figure 6F:
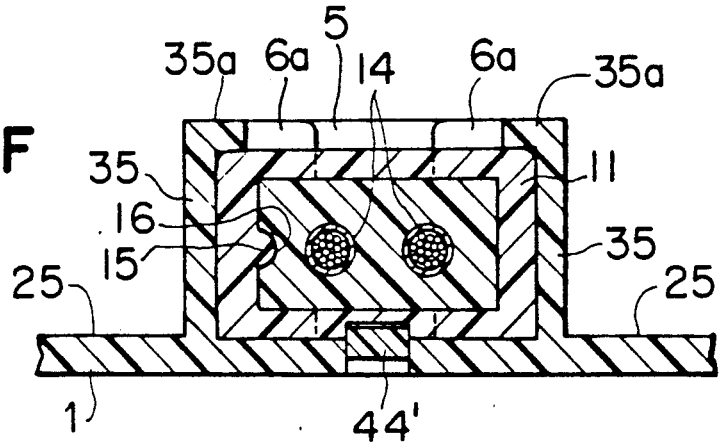

A further embodiment of an electrical connector according to the present invention is shown in accompanying FIGS. 1D–6D, respectively. The embodiment depicted in FIGS. 1D–6D is essentially similar to the embodiment of the present invention described above with respect to FIGS. 1C–6C. One principal difference, however, is that the resilient tongue element 44 is provided integrally with the supporting surface 23A associated with the base 1 and is upwardly and rearwardly inclined. A recessed surface 104, on the other hand, is defined in the bottom wall 11*b* of the tubular housing 11 so as to receive the tongue element 104 therein. The rearwardmost edge of the tongue element 44*a* (see FIG. 2D) will thus enter the recessed surface 104 and will prevent withdrawal of the tubular housing 11 from its position when coupled to the base 1 (e.g., as shown especially in FIGS. 3D and 4D).

FIGS. 1E–6E depict a further embodiment according to the present invention. As shown, the base 1 is provided with a support surface 25*a* which is an integral extension of the upper surface 25 thereof. A recessed surface 43' is centrally defined within the support surface 25*a* near the forward edge of base 1. A pair of opposing upright flanged walls 35 each terminating in an inwardly turned flange member 35*a* are provided and extend continuously from the forwardmost edge of the base 1 to adjacent the vertically extending retaining wall 5.

The tubular housing 11 of this embodiment of the invention is provided with a downwardly and forwardly slanted resilient tongue element 101'' which engages the recess 43' when the tubular housing 11 is in its final coupled position with respect to base 1. In this regard, the tubular housing 11 is capable of being slidably received within the space established by the walls 35 and their respective flanges 35*a*, the latter engaging the upper wall of the tubular housing 11. It will be noted that the flanges 35*a* associated with the flanged walls 35, together with the interengagement of tongue element 10*a''* and recessed surface 43' will securely couple the tubular housing 11 to the base 1.

A further embodiment of this invention is depicted in FIGS. 1F–2F and 4F–6F, and is somewhat similar to the embodiment described above in connection with FIGS. 1D–6D. (Ntte for example, that the perspective view of this embodiment of the invention would be essentially identical to FIG. 3E.) However, the principal differences therebetween are that the embodiment of FIGS. 1F–2F and 4F–6F includes an upwardly and rearwardly slanted tongue element 44' associated with the support surface 23A of the base 1, and a recessed surface 104' is defined in the bottom wall 11*b* of the tubular housing 11. The resilient tongue element 44' will thus extend upwardly into the recessed surface 104' when the tubular housing 11 is coupled to the base 1, thereby preventing uncoupling of the same and capturing the base portions 7A of the male connecting members 7 in a manner similar to that described above.

As the reader will appreciate, a variety of modifications may be made to the electrical connectors according to the present invention without departing from the scope thereof. Some of the modifications are shown in accompanying FIGS. 11A–12A and 11B–12B. For example, the electrical connector shown in FIGS. 11A–12A is similar to that described above with respect to FIGS. 1C–6C. However, in the electrical connector of FIGS. 11A–12A, a vertical stop plate 4 is provided at a forward edge of the base 1 and against which the resilient tongue element 10 (see FIG. 12A) associated with the tubular housing 11 is engaged when the tubular housing 11 is in its coupled position (see FIG. 11A).

The embodiment of the invention shown in FIGS. 11B–12B is similar to the electrical connector described above with reference to FIGS. 1D–6D. However, in the electrical connector shown in FIGS. 11*b*–12B, a stop plate (not shown) extends downwardly into the channel 11′ defined in the bottom wall 11*b* of the tubular housing 11. The upwardly and rearwardly slanted resilient tongue element 44″ associated with the bottom surface 23A of base 1, will thus engage the stop plate to prevent uncoupling of the tubular housing 11 for the base 1.

FIGS. 13A–13D each show alternative forms of the base 1 that may be incorporated into the electrical connectors of the present invention. More specifically, FIGS. 13A–13D each shows an alternative embodiment of the base 1 whereby the upright retaining wall 5 includes a centrally located column member 5*a*′ that separates a pair of horizontally disposed male terminals 7′. In these embodiments, the bus bar 6′ is laterally disposed so that the housing (not shown in FIGS. 13A–13D) will capture the base sections 7A′ against the retaining wall 5′ in a manner similar to that described above.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An electrical connector comprising:

an electrically insulating base member having an upright retaining wall establishing a forward surface;

at least one electrically conductive bus having a base section disposed adjacent said forward surface of said retaining wall, and a male terminal extending from said base section in a forwardly direction;

a tubular housing positioned forwardly of said retaining wall, and having a rear wall which defines an opening through which said male terminal extends so that said male terminal is present within said tubular housing; and coupling means for coupling said tubular housing and said base member so that said rear wall of said tubular housing exerts a force against said base section of said conductive bus so as to positionally capture said base portion against said retaining wall, whereby said male terminals are rigidly fixed within said tubular housing.

2. An electrical connector as in claim 1, wherein said coupling means includes a pair of guide rails formed on said base member, and a pair of grooves formed in said tubular housing, each of said grooves slidably mating with a respective one of said guide rails.

3. An electrical connector as in claim 2 wherein said base member defines an open area which establishes a pair of opposing separated edges, and wherein said pair of opposing separated edges constitute said guide rails.

4. An electrical connector as in claim 3, wherein a pair of said tongue means is integrally associated with a respective one of said edges established by means of said opening, and wherein each said pair of tongue means includes a relief slot formed in said base member laterally of said tongue means, said relief slot allowing said tongue means to be resiliently laterally spread apart upon coupling of said plug housing to said base member.

5. An electrical connector as in claim 4, wherein each tongue means includes an engagement surface which engages a forward portion of said housing and thereby couples said housing to said base.

6. An electrical connector as in claim 4, wherein said pair of tongue means collectively establish a respective pair of divergent cam surfaces for laterally resiliently spreading said tongue means apart when a rear wall of said housing engages said cam surfaces during coupling of said housing to said base.

7. An electrical connector as in claim. 1, wherein said coupling means includes a resilient tongue means associated with said tubular housing, and an upright stop plate at a forward portion of said base member and against which said resilient tongue means abuts when said housing is in said mounted position thereof.

8. An electrical connector as in claim 7, wherein said tongue means includes a downwardly and forwardly slanted resilient tongue element.

9. An electrical connector as in claim 1, wherein said coupling means includes opposing pairs of upright claw posts associated with said base member, and a pair of flanges associated with said housing and adapted to being slidably mated with said pairs of claw posts.

10. An electrical connector as in claim 1 wherein said coupling means includes a resilient slanted tongue element terminating in an edge associated with one of said base member and said housing, and a recessed surface defined in the other of said base member and said housing, said tongue element being mateably registered with said recessed surface so that said edge thereof engages said recessed surface when said housing is coupled to said base member.

11. An electrical connector as in claim 1, wherein said coupling means includes an opposing upright pair of walls associated with said base member, each said wall terminating in an inwardly turned flange so as to establish a mounting space that is sized and configured to accept therein said housing.

12. An electrical connector as in claim 1, further comprising a female plug body adapted to being mateably inserted within said tubular housing.

13. An electrical connector as in claim 12, further comprising means for establishing the coupling orientation of said female plug body and said housing.

14. An electrical connector comprising:

a base member formed of an electrically insulating material and having forward and rearward portions;

said base member including an upright retaining wall formed at said rearward portion thereof;

a pair of parallel electrically conductive male terminals each having a base section disposed adjacent said upright retaining wall and forwardly extending from said base section towards said forward portion of said base member;

a tubular plug housing defining an interior space for accommodating and housing said pair of male terminals therewithin; and coupling means for coupling said plug housing to said base, said coupling means including, (i) mounting means which allows said plug housing to be slidably moved onto said base in a direction towards said upright wall so that said plug housing will assume a mounted position relative to said base; and (ii) resilient tongue means for capturing said plug housing when in said mounted position relative to said base, and for preventing said plug housing from being forwardly withdrawn relative to said upright wall, whereby said plug housing is coupled to said base and is positionally retained thereby relative to said male terminals.

15. An electrical connector as in claim 14, wherein said mounting means includes a pair of guide rails formed on said base member, and a pair of grooves formed in said tubular plug housing, each of said grooves slidably mating with a respective one of said guide rails.

16. An electrical connector as in claim 15, wherein said base member defines an open area which establishes a pair of opposing separated edges, and wherein said pair of opposing separated edges constitute said guide rails.

17. An electrical connector as in claim 14, wherein said tongue means is integrally associated with each said edge established by means of said opening, and wherein said tongue means includes a relief slot formed in said base member laterally of said tongue means, said relief slot allowing said tongue means to be resiliently laterally spread apart upon coupling of said plug housing to said base member.

18. An electrical connector as in claim 14, wherein said coupling means includes an upright stop plate at said forward portion of said base member and against which said resilient tongue means abuts when said plug housing is in said mounted position thereof.

19. An electrical connector as in claim 14 or 18, wherein said tongue means includes an downwardly and forwardly slated resilient tongue element.

20. An electrical connector as in claim 14, wherein said mounting means includes opposing pairs of upright claw posts associated with said base member, and a pair of flanges associated with said plug housing and adapted to being slidably mated with said pairs of claw posts.

21. An electrical connector as in claim 14 wherein said coupling means includes a resilient slanted tongue element terminating in an edge associated with one of said base member and said plug housing, and a recessed surface defined in the other of said base member and said plug housing, said tongue element being mateably registered with said recessed surface so that said edge thereof engages said recessed surface when said plug housing is in said mounted position.

22. An electrical connector as in claim 14, wherein said mounting means includes an opposing upright pair of walls associated with said base member, each said wall terminating in an inwardly turned flange so as to establish a mounting spaced that is sized and configured to accept therein said plug housing.

23. An electrical connector as in claim 14, further comprising a female plug body adapted to being mateably inserted within said plug housing.

24. An electrical connector as in claim 23, further comprising means for establishing the coupling orientation of said female plug body and said plug housing.

25. An electrical connector as in claim 24, wherein said means for establishing said coupling orientation includes a mateable tongue and groove assembly associated with one and the other of said plug housing and said female plug body, respectively.

26. An electrical connector comprising:

a plastic insulating base;

an opening defined in said base;

a pair of opposing mirror-image L-shaped slots formed in said base at a forward end of said opening;

said opening having a pair of side edges which establish a pair of guide rails;

an upright retaining wall formed on said base at a rearward position of said guide rails;

an upwardly projecting stop plate formed integrally with said base between said L-shaped slots;

an elongated conductive plate mounted to said retaining wall and having a forwardly bent portion in the form of a forwardly extending male terminal;

a tubular housing having a hole formed in a rear wall thereof for allowing said male terminals to extend therethrough and into the interior of said housing;

coupling means for coupling said housing to said base, said coupling means including a resilient tongue means associated with one of said base and said housing and having an edge which engages a surface associated with the other of said base and said housing, whereby said base and housing are coupled to one another; and a female plug body inserted into said tubular housing and having female terminals coupled to said male terminals within said interior of said housing.

* * * * *